US006024640A

United States Patent [19]

Walker et al.

[11] Patent Number: 6,024,640

[45] **Date of Patent: *Feb. 15, 2000**

[54] OFF-LINE REMOTE LOTTERY SYSTEM

[75] Inventors: Jay Walker, Ridgefield, Conn.; Bruce Schneier, Oak Park, Ill.

[73] Assignee: Walker Asset Management Limited Partnership, Stamford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/858,123

[22] Filed: May 19, 1997

Related U.S. Application Data

[63] Continuation of application No. 08/497,080, Jun. 30, 1995, abandoned.

[51] Int. Cl.[7] ..... A63F 9/22

[52] U.S. Cl. ..... 463/17; 463/40

[58] Field of Search ..... 273/269, 139 R; 463/17, 18, 16, 42, 41, 40

[56] References Cited

U.S. PATENT DOCUMENTS

| | | | |
|---|---|---|---|
| 4,652,998 | 3/1987 | Koza et al. | 273/138 A X |
| 4,689,742 | 8/1987 | Troy et al. . | |
| 4,760,527 | 7/1988 | Sidley . | |

(List continued on next page.)

FOREIGN PATENT DOCUMENTS

| | | |
|---|---|---|
| 0032410 | 7/1981 | European Pat. Off. . |
| WO 8602752 | 5/1986 | European Pat. Off. . |
| 88106187 | 9/1988 | European Pat. Off. . |
| 0405776A2 | 1/1991 | European Pat. Off. . |
| 0478412A1 | 4/1992 | European Pat. Off. . |
| 0487446A2 | 5/1992 | European Pat. Off. . |
| 2697653 | 5/1994 | France . |
| 01258178 | 1/1990 | Japan . |
| 01269158 | 1/1990 | Japan . |
| 01269164 | 1/1990 | Japan . |

(List continued on next page.)

OTHER PUBLICATIONS

John C. Dvorak, Gambling on a PC Near You, PC Magazine, v14, n9, p. 89 May 16, 1995.

Newsbyte News Network, Interactive Network Forms Real–Time Gambling Subsidiary Dec. 7, 1994.

SCTT Marketing Inc. Interactive Network Sets Up Gaming Subsidiary V.1, No. 25; Dec. 1994.

Interactive Network Interactive Network Launches Wagering Unit, Multimedia Bus. Rpt. Dec. 2, 1994.

Warren Publishing, Inc. Games of Chance Worldwide, V. 14 No. 230, Nov. 30, 1994.

Michael Conniff Don't Bet Against Harrah's When it Comes to ISDN May 1, 1989 V.2 No. 5.

Phillips Publishing, Inc. Agent Speaks Directly to the Customer on the Screen v.2 No. 4 Mar. 1, 1989.

Phillips Publishing, Inc. Harrah's Reno Uses hybrid ISDN to Attract Customers V. 10 No. 3 Mar. 1989

*Primary Examiner*—Jessica Harrison
*Assistant Examiner*—Michael O'Neill
*Attorney, Agent, or Firm*—Morgan & Finnegan LLP

[57] ABSTRACT

An off-line remote lottery system which enables players to purchase instant-type lottery game outcomes from a randomized prize datastream in a central computer and view the outcomes on remotely disposed gaming computers which do not require an on-line connection to the central computer during play, the central computer storing identification data for a plurality of gaming computers and being configured for randomly assigning outcomes from the randomized prize datastream to the gaming computers in response to purchase requests by players for a requested number of outcomes in each purchase request, each gaming computer including a game program in memory for execution on the gaming computer to generate games which yield the purchased outcomes or aggregate net payoff of the purchased outcomes, and a redemption function for generating a redemption request to cash-out winnings, the system enabling outcome purchase and redemption of winnings to be effectuated directly with the central computer over a telephone network, or via a plurality of agent terminals located at various lottery retailers.

6 Claims, 15 Drawing Sheets

U.S. PATENT DOCUMENTS

| | | | |
|---|---|---|---|
| 4,764,666 | 8/1988 | Bergeron | 273/139 X |
| 4,842,278 | 6/1989 | Markowicz | 273/138 A |
| 4,856,787 | 8/1989 | Itkis . | |
| 4,982,337 | 1/1991 | Burr et al. | 364/412 X |
| 5,042,809 | 8/1991 | Richardson . | |
| 5,119,295 | 6/1992 | Kapur . | |
| 5,179,517 | 1/1993 | Sarbin et al. . | |
| 5,223,698 | 6/1993 | Kapur . | |
| 5,239,165 | 8/1993 | Novak | 364/412 X |
| 5,276,312 | 1/1994 | McCarthy | 364/412 X |
| 5,277,424 | 1/1994 | Wilms . | |
| 5,283,734 | 2/1994 | Von Kohorn . | |
| 5,324,035 | 6/1994 | Morris et al. | 273/439 X |
| 5,330,185 | 7/1994 | Wills | 273/139 X |
| 5,398,932 | 3/1995 | Eberhardt et al. | 273/138 A |
| 5,415,416 | 5/1995 | Scagnelli . | |
| 5,417,424 | 5/1995 | Snowden et al. | 273/138 A |
| 5,518,253 | 5/1996 | Pocock . | |

FOREIGN PATENT DOCUMENTS

| | | | |
|---|---|---|---|
| 01316869 | 3/1990 | Japan . | |
| 02110660 | 7/1990 | Japan . | |
| 03269763 | 2/1992 | Japan . | |
| 635944 | 5/1994 | Japan . | |
| 2121596A | 12/1983 | United Kingdom . | |
| 2148135 | 5/1985 | United Kingdom | 273/139 |
| WO 9216914 | 10/1992 | WIPO . | |
| WO 9319428 | 9/1993 | WIPO . | |
| WO 9419906 | 9/1994 | WIPO . | |
| WO 9505876 | 3/1995 | WIPO . | |

OFF-LINE REMOTE LOTTERY SYSTEM

This is a continuation of application Ser. No. 08/497,080, filed on Jun. 30, 1995 now abandoned.

BACKGROUND

The present invention relates generally to remote gaming systems, and more particularly, to a lottery system in which lottery games typically embodied in a ticket having multiple chances which represent a single outcome offered by a lottery authority are rendered on a gaming computer as an "electronic ticket," such as, for example, a dedicated hand-held device or programmed general personal computer, which enables a player to reveal the ticket outcome with the same convenience as typical paper scratch-off tickets at any location without the gaming computer ever having to be physically or electronically connected to a lottery system network during play, thereby providing enhanced play value for the player and greater revenues for the lottery authority.

In one type of common prior art paper instant ticket system, a computer generates a randomized prize datastream comprised of a finite series of win/lose outcomes. Each outcome is assigned to a lottery ticket, and each ticket contains one or more game chances which yield the assigned outcome. The player cannot change the ticket outcome, he or she merely scratches off certain areas of the ticket in accordance with the rules of the game to reveal the outcome. The ticket contains indicia which provide the player with a means to determine win/lose results or prize status, and the type of prize (e.g., cash or a free ticket). The aggregate of all winning outcomes in any randomized prize datastream is a predetermined percentage payout of the total revenues that would be generated by the sale of all of the tickets incorporating that particular randomized prize datastream.

Each ticket is assigned a unique ticket serial number for validation purposes which identifies that ticket with a specific outcome, and a batch number which links the ticket to a master carton in which groups of tickets are shipped to lottery retailers in specific quantities. The ticket serial number is usually concealed beneath the foil of the ticket. The batch number is typically visible on the ticket in the form of a bar code. All tickets in a given master carton are part of the same ticket lot and are sold at the same price point. Each master carton is labeled with a unique master carton serial number which is tracked by a central computer associated with the lottery authority. The central computer also stores every ticket serial number and the associated outcome for that ticket. When the instant tickets are to be sold to customers, the lottery retailer communicates the master carton serial number via his on-line agent terminal to the lottery central computer and thereby activates all of the paper instant tickets in each master carton. This action activates all of the ticket serial numbers in that master carton, and typically causes the lottery retailer's lottery bank account to be automatically debited for the wholesale cost of that master carton within a specified time period.

To redeem a winning paper lottery ticket, the player presents the same to a redeeming agent, either at a lottery retailer or lottery office, or mails the ticket in for redemption. To effectuate the redemption process, the redeeming agent scans the bar code on the ticket which represents the batch serial number on the ticket through a bar code scanner associated with the agent terminal. The ticket agent also enters the ticket serial number into the agent terminal. These ticket serial numbers are transmitted to the central computer for purposes of validation. When the central computer receives a validation request, it activates an on-line validation program which queries a ticket value database using the particular ticket and batch serial numbers to confirm that the ticket came from an activated master carton. If the ticket value database confirms a payout, the validation program authorizes the lottery retailer to pay the player cash or provide another prize (e.g., a free ticket).

In other paper instant ticket systems, there is no lottery central computer which manages the system. The lottery retailer simply buys tickets from a printer, resells them to players, and then handles all aspects of validation and payment of winnings.

Paper instant ticket systems suffer from several drawbacks. These include the costs of printing tickets, the physical inventory costs, the costs to the lottery authority and retailer associated with unsold tickets, the inability to effectively offer low-price games (e.g., $0.25, $0.10), the limited game choices for the player, and the stigma associated with paper tickets as appealing toward lower income players, among others.

As an alternative to instant paper tickets, systems have been devised which replicate instant tickets on a computer terminal or gaming machine. An example is shown in U.S. Pat. No. 5,324,035, which discloses an on-line video gaming system comprised of a plurality of slave terminals, a plurality of master processing units, and a central game processor. A plurality of slave terminals are networked to each master processing unit and all of the master processing units are networked to the central game processor. The central game processor downloads fixed pools of game plays to each master processing unit. The slave terminals request game plays from the fixed pool in the master processing unit. The group of slave terminals coupled to a particular master processing unit display indications of the chances of purchasing one of the remaining winning plays in that pool to provide an element of competition between players situated at the various slave terminals. Thus, players at each slave terminal may decide to wait for the odds of purchasing a winning play to increase by allowing other competitors to purchase some of the remaining non-winning plays. Although this system is capable of rendering instant paper tickets in a video format, its primary drawback is that it is a networked on-line system. Every play (outcome) requested by the slave terminal must be downloaded on-line from the master processing unit. Accordingly, this system is limited in that players can only engage in lottery play at specified locations.

Another on-line video gaming system is disclosed in U.S. Pat. No. 4,652,998. This system comprises a plurality of remote terminals networked to a central controller which generates a prize pool based upon a pool seed which is fed to a random number generator. The central controller divides the prize pool into mini-pools, each of which has a known amount of low-end prize value (e.g., all prizes of $25 or less). There are a selected number of larger prizes which are distributed among the mini-pools where some mini-pools have a large prize and some have none. Mini-pools are assigned to each terminal for each game which is rendered on the terminal as needed. The remote terminals have means for randomizing each mini-pool assigned to the terminal using a mini-pool seed provided by the central controller to feed a random number generator using a randomizing algorithm. When the central processor has assigned all mini-pools within a pool, the central processor creates a new pool. After players have played a sufficient number of games to exhaust an entire mini-pool at a given remote terminal, it connects to the central controller and is assigned a new mini-pool. This system also has significant limitations. Because the prize structure in the mini-pools is assigned to each remote terminal in a "dynamic state", i.e., the remote terminal is assigned active outcomes before a player engages in play, it is necessary to provide various security measures in the remote terminals to prevent an unscrupulous player from "looking ahead" by "hacking" the machine and determining the outcome sequence in any given mini-pool. Otherwise, a player might learn at what point in the mini-pool a large win will occur for the game being played and then wait to play until when a favorable outcome is due to occur. This characteristic thus makes such a system unsuitable for an off-line arrangement where players are free to purchase "tickets" and view the outcomes at any location.

It is therefore desirable to provide an off-line system in which a player can enjoy games having a predefined outcome determined by a lottery authority or the like on a gaming device, without the need to be physically or electronically linked to a central computer associated with the lottery authority during play, where "ticket" purchase and redemption of winnings may be done at virtually any location, and where the lottery authority is not at risk of being cheated since there are no secrets stored in the device.

SUMMARY OF THE INVENTION

Accordingly, it is a primary object of the present invention to provide a lottery system whereby instant "tickets" or psuedo-choice games with a predetermined outcome can be rendered on a gaming computer (the gaming computer may be any personal computer, personal digital assistant or the like, but will be referred to herein as a hand-held ticket viewer "HTV") to enable a player to participate in a lottery at any location as with instant paper tickets, all the while providing enhanced play value through computer simulation of games on the HTV.

It is a further object of the present invention to provide a lottery system which allows for replicating outcomes on a HTV where the outcomes are stored in a record on a lottery central computer ("LCC") with identification data for that HTV to eliminate the need for security in the HTV.

It is yet another object of the present invention to provide a lottery system which enables outcomes to be replicated on an HTV and redemption at a lottery retailer with the same convenience as with instant paper tickets.

It is a further object of the present invention to provide a lottery system which provides for the portability of outcome purchase and redemption through any interactive communications network such as the Internet or simply over the telephone.

It is another object of the present invention to provide a lottery system which provides a lottery authority with increased sales and profits, more competitive entertainment alternatives and higher customer satisfaction.

It is a further object of the present invention to provide a lottery system which eliminates printing costs, inventory costs and cash flow delays associated with instant paper tickets.

It is a further object of the present invention to provide a lottery system which eliminates the disposal costs associated with paper instant tickets.

It is yet another object of the present invention to provide a lottery system in which an HTV provides for a longer play time than that possible with instant paper tickets.

It is yet another object of the present invention to provide a lottery system in which games rendered on an HTV may be provided in a large type option which generates larger game formats to make it easier for people with poor vision to play the games.

It is another object of the present invention to provide a lottery system which allows for venue expansion through sales of instant ticket type games in venues where sales of paper tickets are impractical such as in restaurants and the like.

It is still another object of the present invention to provide a lottery system in which game tutorials and help screens on a HTV enable players to learn new lottery games.

It is yet another object of the present invention to provide a lottery system in which games are rendered on a HTV and the machine tells the player when he or she is a winner.

It is a further object of the present invention to provide a lottery system in which new lottery games may be transferred to a HTV through a plug-in module.

It is still another object of the present invention to provide a lottery system in which the lottery authority can inexpensively test new games and obtain user feedback by transferring new games for user sampling to a HTV through a plug-in module.

It is yet another object of the present invention to provide a lottery system in which advertising in connection with any lottery game may be transferred to and replicated on a HTV.

It is a another object of the present invention to provide a lottery system in which games which are races of skill such as crossword puzzles or word descrambler games which must be completed in a certain period of time but which have a predetermined outcome are rendered on a HTV.

It is a further object of the present invention to provide a lottery system which increases lottery sales and player game value by providing for the reinvestment of winnings on a HTV.

It is yet another object of the present invention to provide a lottery system which allows for a lottery authority to track players and their frequency of play on a database to provide bonus awards and incentives.

It is still another object of the present invention to provide a lottery system which reduces player fatigue by enabling a player to select from a plurality of games on a HTV irrespective of the predetermined outcomes purchased from the lottery authority.

It is a further object of the present invention to provide a lottery system which reduces ticket and validation costs for the lottery authority through electronic batching and reduced claim "events."

It is another object of the present invention to provide a lottery system which makes instant ticket type lottery games attractive to a wider group of participants who enjoy playing games on machines and personal computers.

It is a further object of the present invention to provide a lottery system in which a HTV may be enabled for play and disabled in accordance with its location using a Global Positioning System ("GPS") receiver to facilitate in-flight gaming where the HTV may be prevented from operating unless it is located within a venue that allows for gaming.

In accordance with the above objects and additional objects that will become apparent hereinafter, the present invention in a first embodiment provides a remote off-line lottery system generally comprised of at least one HTV for revealing "tickets" (outcomes) purchased from a lottery or wagering authority ("lottery authority"); a LCC; and a telecommunications network which provides remote terminal access to the LCC from a plurality of agent terminals ("AT") located at various lottery retailers where the player can go to purchase outcomes and redeem winnings.

The LCC contains software or firmware which generates a randomized prize datastream ("RPD") comprised of a finite series of win/lose outcomes. The aggregate of all winning outcomes in any RPD is a predetermined percentage payout of the total revenues to be generated by the sale of all of the outcomes in the RPD. The LCC stores a record of identification data in memory for registering a plurality of HTVs with the lottery authority and may store information with respect to individual players to allow for bonus awards and incentive programs.

In the first embodiment, the player goes to a lottery retailer having an AT and requests to purchase m "tickets." The agent obtains identification information in the form of an outcome purchase request message OPRM from the HTV and enters it into the AT which communicates this information to the LCC where the HTV is verified as a properly registered unit. The agent then provides the number of outcomes requested m. The LCC randomly assigns the next m outcomes from the RPD and stores a record of the outcomes purchased with the identification data for that HTV. Thus, the LCC knows exactly which HTV has been provided with which outcomes for future redemption of winnings. The LCC then generates an outcome transfer message OTM and communicates the same to the AT. The outcome transfer message OTM may be printed out on a receipt at the AT and provided to the player for manual entry into the HTV. The outcome transfer message OTM may be rendered in the form of a bar code on the receipt to enable being scanning by a bar code scanner associated with the HTV. Alternatively, the outcome transfer message OTM may be written to data memory media such as a smart card with a read/write interface associated with the AT, where the HTV has an associated read/write interface for reading the outcome transfer message OTM from the smart card. In yet another embodiment, the AT and the HTV both include means for physically coupling the HTV to the AT to enable the HTV to directly read the outcome transfer message OTM from the AT. In still another embodiment, the outcome transfer message OTM may be spoken into a microphone in the HTV where the HTV has voice activated circuitry for reading the message. Further embodiments described below in which there is no AT required, include a telephone embodiment where the player obtains the outcome transfer message OTM over the telephone and then manually enters it into the HTV, or where the HTV includes a modem for obtaining the outcome transfer message OTM directly over a telephone line. In still another embodiment, the HTV may include a transceiver for receiving an outcome transfer message which is broadcast through RF communications between a base station associated with the LCC and the HTV.

The HIS contains software or firmware which enables it to generate games which reveal the purchased outcomes represented in the outcome transfer message OTM. The games may be updated in the HTV by transferring new game programs to the HTV via a smart card or the like. The software also allows for the generation of games for practice sessions or tutorials for the games to teach players how to play. The games reveal the predetermined outcomes and may be "no-choice" as with instant paper tickets, bingo games or a sweepstakes; or psuedo-choice (e.g., video poker with a predetermined outcome if the player plays every hand correctly). The outcome transfer message OTM may represent the outcomes selected from the RPD in a compressed sequence. This enables a simple code to be printed on a receipt for manual entry or bar code scanning. In another embodiment, a reference string HTVRS containing a very large series of random outcomes is identically stored in both the LCC and the HTV. The outcome transfer message OTM represents an address or addresses in the HTVRS which contain a sequence of outcomes that either identically match those outcomes selected from the RPD or the net payoff on those selected outcomes. In another embodiment, both the LCC and the HTV store a one-way algorithm for generating outcomes in response to a seed value. The seed value is selected by the LCC to generate the outcome sequence from the RPD. The outcome transfer message OTM represents this seed value. Once the HTV is provided with the outcome transfer message OTM by any of the above methods, it generates games which yield the outcomes or the net payoff on those outcomes.

To prevent an outcome transfer message OTM from being used in the wrong HTV, the outcome transfer message OTM may be encrypted by the LCC using keys known only to the LCC and a particular HTV for decryption in that HTV. Similarly, the outcome transfer message OTM may include message authentication codes which are verified at the HTV using keys known only to the LCC and that HTV. The LCC and the HTV may store a chaining variable for the particular HTV which is updated as a one-way function of all outcomes that have been purchased or played by that HTV. The chaining variable is updated by the LCC every time an outcome purchase is made and by the HTV every time the HTV receives a new outcome transfer message. The chaining variable may then be used to generate a new OPRM every time an outcome purchase request is made to the LCC, and/or as an encryption or message authentication key.

In one embodiment, additional outcomes are provided to allow for player reinvestment. These outcomes are referred to herein as "standby outcomes." Thus, a given outcome purchase for m outcomes may include x standbyoutcomes which enable the player to reinvest winnings on the m purchased outcomes. The number of standby outcomes included in a given purchase may be selected so as to eventually provide for total exhaustion of winnings or a large prize above some predetermined threshold by the lottery authority. This will be explained in more detail below.

As the HTV generates games which reveal the outcomes, the cash balance is updated in an account stored in the HTV. The LCC Similarly knows the net pay-off for a given purchase. When the player seeks to cash out, he or she either provides the agent at the AT with a redemption request message RRM or communicates the redemption request message RRM directly to the AT using any of the methods described above with respect to the outcome transfer message OTM. The AT transmits the redemption request message RRM to the LCC, which verifies the identity of the HTV and the expected payout for that HTV. If standby outcomes were assigned, the redemption request message RRM includes a representation of which standby outcomes were revealed by the HTV. Any standby outcomes which were not revealed are voided as part of the redemption process. The player is then paid by the lottery retailer, or if the prize has significant monetary value, the player may be required to send in a form for subsequent payment from the lottery authority.

In one alternative embodiment, the LCC is coupled to a telecommunications network having interactive voice capability and is accessible by dialing a 900 number or the like to enable the outcome purchase and redemption to be effectuated over the telephone. The player simply keys the information into the telephone in response to prompts from the system. Thus, the player first communicates the HTV identification information to the LCC. If HTV identification is confirmed, the LCC then provides a "ready" indication to the player with instructions to select the number of outcomes to be purchased for each price point. The LCC then generates an outcome transfer message OTM as described above which the player manually keys into the HTV. The system operates similarly to redeem winnings. The HTV generates a redemption request message RRM, and the player keys the redemption request message into the telephone. The redemption request message RRM is communicated to the LCC, which verifies the identity of the HTV and the expected payoff. A credit is then made to an account for the HTV/player in the LCC. In a modification of this embodiment, the HTV contains a modem which enables it to communicate directly over the telecommunications network to communicate outcome transfer messages OTM from the LCC to the HTV and redemption request messages from the HTV to the LCC. In this connection, the system could operate over any interactive communications network such as the Internet. Alternatively, the HTV may incorporate a cellular phone for the same purpose. This embodiment is still considered to be an off-line arrangement as there is no need to have an on-line connection between the HTV and the LCC during play.

In a further embodiment, the LCC and each HTV include transceivers for broadcasting and receiving RF communications of respective messages. Thus, the player need not travel to a lottery retailer to purchase outcomes or to redeem winnings.

These and other features and advantages of the present invention will be better understood with specific reference to the detailed description which follows and the appended drawings.

DETAILED DESCRIPTION OF THE PREFERRED EMBODIMENTS

Figure 1:
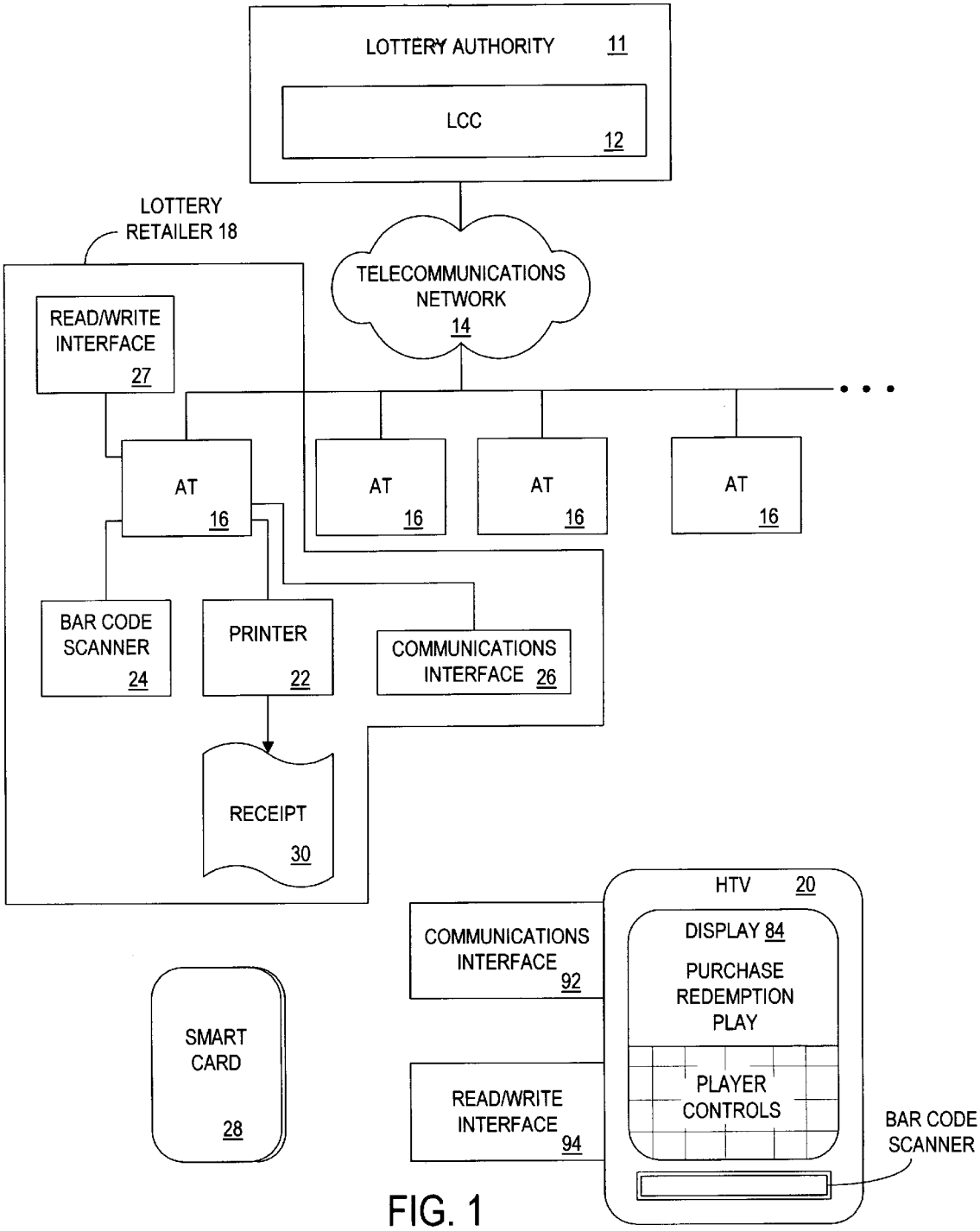
FIG. 1 is a schematic of the remote lottery system showing an LCC, ATs and HTV in a first embodiment.

With reference to the several views of the drawings, there is depicted a lottery system generally characterized in a first embodiment by the reference numeral 10, and principally comprised of a lottery authority 11 having a LCC 12, a telecommunications network 14 which provides remote terminal access to the LCC 12, a plurality of agent terminals (AT) 16 associated with various lottery retailers 18, and a plurality of HTV units 20 which reveal purchased "tickets" outcomes. The term "lottery authority" is used in the general sense and is intended to include any wagering authority which sells no choice (e.g., scratch-off lottery tickets, bingo or a sweepstakes) or psuedo-choice (e.g., video poker) games or races of skill having a predetermined outcome if the player plays correctly. The term "lottery retailers" includes any merchant where an AT 16 is located. As described in the foregoing, the term "ticket" as used herein means a single outcome. Thus, the player is really purchasing outcomes from the LCC which are transferred to the HTV 20 and revealed through games generated on the HTV 20. As will be explained in more detail below, the player need not go to a given lottery retailer to purchase outcomes. It is anticipated that, in alternative embodiments, the LCC 12 and AT 16 may be combined into a single unit or even into a system which enables outcomes to be purchased over the telephone or any interactive communications network. Alternatively, outcomes could be purchased through RF communications between a transceiver associated with the LCC 12 and a transceiver associated with the HTV 20. These embodiments are described further below.

FIG. 1 is a schematic block diagram depicting an overview of the system components in the first embodiment. The LCC 12, telecommunications network 14 and ATs 16 are connected in similar fashion as those in the prior art used to dispense instant paper tickets. With respect to the present invention, each AT 16 may include a printer 22, bar code scanner or other scanning device 24, a communications interface 26 for physically coupling the HTV 20 to the AT 16 to electrically communicate signals with the HTV 20 through a compatible communications interface 92 in the HTV 20, and/or a read/write interface 27 for reading and writing data to data memory media such as a smart card 28. These are used to transfer outcomes to the HTV 20 through an outcome transfer message OTM and will be described in more detail below. The smart card 28 may also be used to update game programs in the HTV 20 to allow for the generation of new games. In this regard, new games may be transferred to the HTV 20 to inexpensively test them for market acceptance by players. The smart card 28 may also be used to transfer advertising information in connection with lotteries in general.

Figure 2:
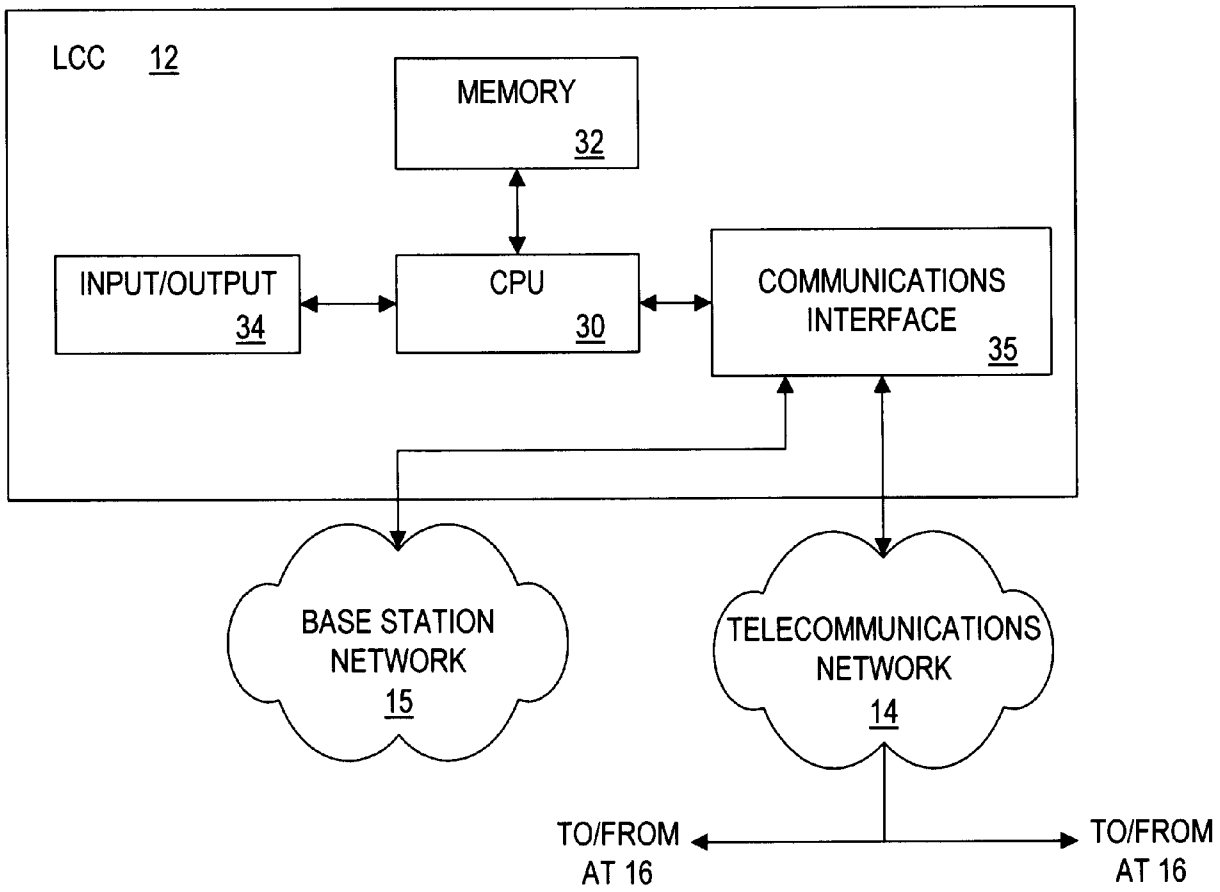
FIG. 2 is a block diagram of the LCC.
Figure 3:
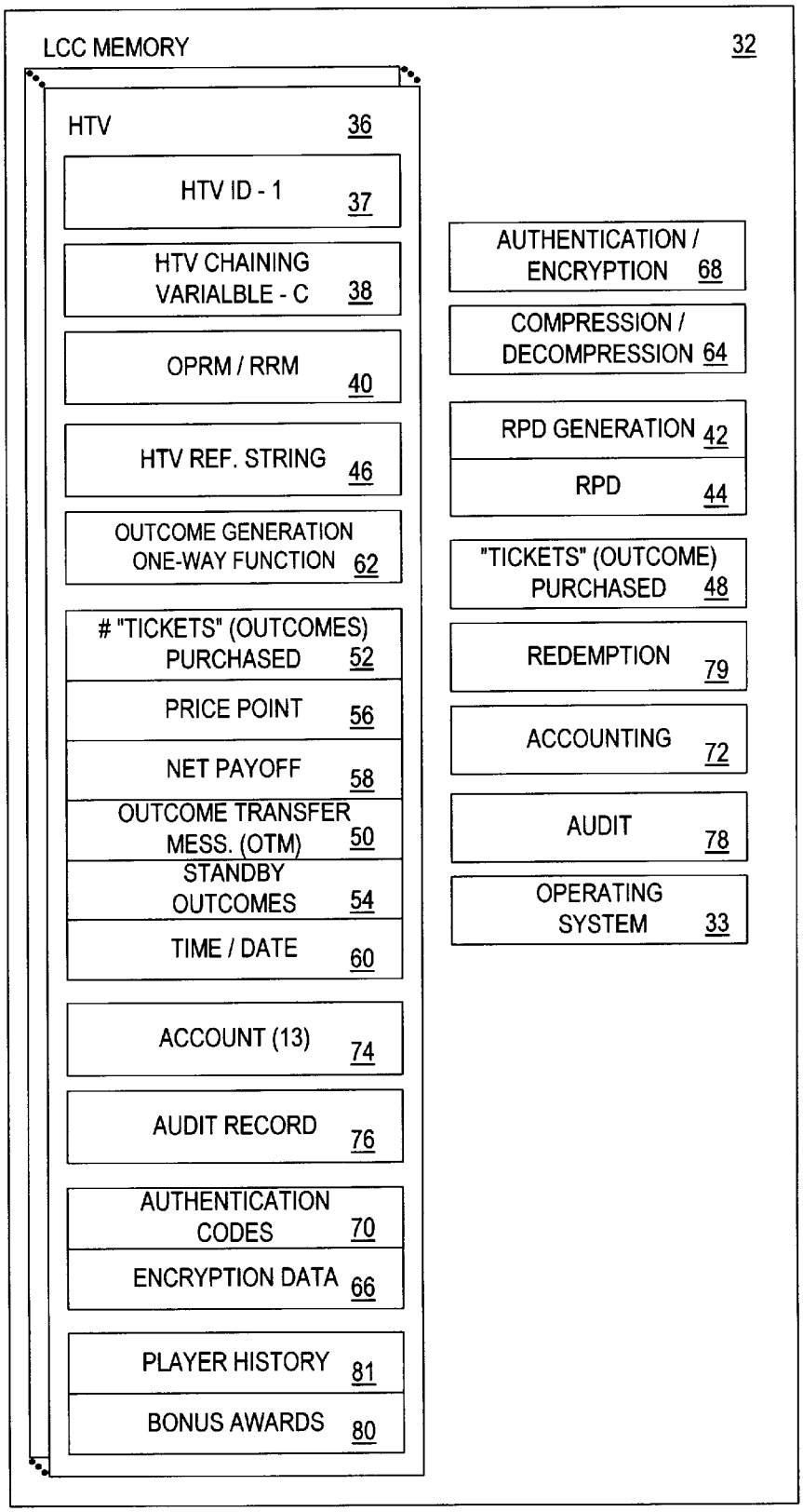
FIG. 3 is a diagram of an exemplary memory arrangement in the LCC.

FIG. 2 is a block diagram showing details of the LCC 12, which generally includes a CPU 30, memory 32, an I/O interface 34 for loading programs into memory 32, and a communications interface 35 for communicating through the network 14 with the ATs 16. The LCC 12 may also communicate through a base station network 15 with a plurality of base stations having transceivers for broadcasting and receiving RF signals to communicate messages directly between the LCC 12 and the HTV 20 in an alternative embodiment described below and illustrated in FIG. 13. The LCC has software or firmware (hereinafter referred to as "programs" and "data") which are used to implement various functions in the system. FIG. 3 depicts an exemplary memory arrangement of programs and data stored in the LCC 12. Memory 32 includes an operating system program 33 which controls the LCC 12 in a conventional manner and need not be described in detail. The LCC 12 has a memory area 36 in memory 32 for each HTV 20 in which specific information is stored to enable the LCC 12 to assign outcomes to that HTV 20 and to keep track of what has been assigned to that HTV 20 to provide for the redemption of winnings and to ensure that the HTV 20 is a verified unit in connection with a given transaction. Data in memory 36 may be retrieved and updated as required in order to perform the desired functions. For purposes of convenience, the following description describes an HTV which is registered to a single player. However, it is anticipated that an HTV 20 may contain multiple accounts for different players where access to the HTV 20 is made available through different passwords. An HTV 20 must be initially registered with the lottery authority 11 prior to use. In this connection, identification information is initially stored in memory 32 of the LCC 12. The identification information includes a unit identifier or HTV ID ("I") stored in a field 37 and optionally a chaining variable ("C") stored in a field 38. I may constitute a 64-bit identifier which is unique to each HTV 20. Similarly, C may constitute a 64-bit representation of the history of outcomes which have been purchased and transferred to the particular HTV 20. Accordingly, C is updated every time purchased outcomes are assigned to the particular HTV 20 as a one-way function of the outcomes purchased. Thus, C is unique to each HTV 20 because it is a record of all transactions made with respect to that HTV 20. In one exemplary embodiment, C is used as a way to prevent fraud by generating an outcome purchase request message OPRM as a function of both I and C in the HTV 20 where OPRM is used to identify the particular HTV 20 during purchase and/or redemption transactions. In this regard, the current OPRM for that HTV 20 is stored in field 40 in the HTV memory area 36 in LCC memory 32 to enable the LCC 12 to compare the generated OPRM with the one stored in memory (which is updated each time outcomes are sold to the HTV 20) from the last transaction to verify the identity of the HTV 20. C and I may also be used as encryption or authentication keys as described below.

The LCC includes a program 42 for generating a random prize datastream ("RPD") 44 which is a pool containing a finite series of win/lose outcomes °, . . . On (e.g., . . . win $2, win $2, lose, lose, win $10, lose, lose . . . etc). The aggregate of all winning outcomes in any RPD 44 is a predetermined percentage payout of the total revenues to be generated by the sale of all "tickets" represented by the outcomes in the RPD 44. When a purchase is made, the LCC 12 utilizes a "ticket" (outcome) purchase program 48 which randomly selects the next m outcomes from the RPD 44 (and possibly "standby outcomes"—x to allow for reinvestment of winnings, this will be described below) to be assigned to a particular HTV 20. The outcome purchase program 48 then directs the LCC 12 to generate the outcome transfer message OTM which is subsequently communicated to and read by the HTV 20 to enable the HTV 20 to reveal the outcomes. There are several ways in which this can be implemented. The outcome purchase program 48 will also direct the LCC 12 to store the outcome transfer message OTM in field 50, a record of the outcomes m assigned in field 52, and the standby outcomes x assigned in field 54. Accompanying this data may be the price point for a given "ticket" (outcome) such as $0.25, $1, $2, etc., in field 56, the net payoff in field 58, and the time/date in field 60. Thus, a record is generated in the LCC 12 for each transaction with a given HTV 20.

In one embodiment, each HTV 20 may be assigned a unique reference string ("HTVRS") which is stored in field 46. An identical HTVRS is stored in the particular HTV 20 as described below. The HTVRS is a random series of win/lose outcomes. When a purchase is made, the outcome purchase program 48 directs the LCC 12 to find the same outcomes or a series of outcomes having the same net payoff in the HTVRS. These outcomes or the net payoff may be represented by one or more memory addresses in the HTVRS. The outcome purchase program directs the LCC 12 to generate an outcome transfer message OTM which represents that address or addresses in the HTVRS. The HTV 20 can interpret OTM to find the same outcomes or a series of outcomes with the same net payoff in its very own HTVRS. This will be explained in more detail below.

Another way in which the LCC 12 can assign outcomes is through the use of a one-way function which utilizes a seed value to generate a sequence of outcomes that are selected from the RPD 44. The HTV memory area 36 in the LCC memory 32 includes such a one-way function in field 62. An identical one-way function is stored in the HTV 20 as described below. The seed value for this one-way function becomes part of an outcome transfer message OTM.

Still another way the LCC can assign outcomes to the HTV 20 is by simply compressing the outcome sequence into a smaller code which is then decompressed in the HTV 20. Specifically, the LCC 12 has a compression/decompression program 64 which takes a series of m outcomes $O_j$ . . . $O_{j+m}$. selected by the outcome purchase program 48 and compresses that sequence into a smaller variable which is part of an outcome transfer message OTM. As part of the compression process, the outcomes $O_j$ . . . $O_{j+m}$ may be rearranged into a hierarchal order, i.e., number of losers, number of $1 winners, number of $2 winners, etc) if desired. Compression is useful in embodiments where the outcome transfer message OTM is printed on a receipt or rendered in the form of a bar code, to allow for manual entry of the outcome transfer message OTM into the HTV 20 or scanning the OTM as described below. Compression is also useful in the telephone embodiment shown in FIG. 12 and described below where the player may communicate messages over the telephone in response to suitable prompts. In this regard, compression and decompression may be used in combination with any of the other methods of transferring outcomes, such as for example, where the HTVRS address is transferred.

In still another embodiment, the outcome purchase program 48 calculates the expected net payoff of the m outcomes $O_j$ . . . $O_{j+m}$, and generates an outcome transfer message OTM which represents that net payoff. In this case, the HTV would randomly generate games which yield outcomes having that net payoff. This method is not suitable for standby outcomes.

In order to provide for added security in the system, the outcome transfer messages OTM may be encrypted using keys known only to the LCC 12 and the particular HTV 20 stored in field 66. An authentication/encryption program 68 provides for the encryption and decryption of messages communicated from the LCC 12 and communicated to the LCC 12. Similarly, messages generated by the LCC 12 may be made authenticatable by appending message authentication codes stored in field 70 such that only a particular HTV 20 using keys known only to the LCC 12 and that HTV 20 can use the message. As described above, the chaining variable C and the unit identifier I may be used as keys to perform encryption/decryption and authentication.

Other programs resident in the LCC memory 32 include an accounting program 72 which calculates the running cash balance for each HTV 20 and stores the same in an account 73 in field 74. The accounting program 72 is used to track the cumulative value of player winnings and losses after the player has cashed-out. The accounting program 72 enables the LCC 12 to duplicate a player's credit balance at any point in the outcome sequence.

The LCC memory 32 further contains an audit program 78 which stores a record of all transactions with a particular HTV 20 in field 76.

The LCC memory 32 also includes a redemption program 79 which provides for verifying winnings to enable a player to cash-out. The redemption program 78 is used to cash-out any winnings in a player's current credit balance. The redemption program 79 directs the LCC 12 to read a redemption request message RRM provided from the HTV 20. The redemption program also determines the number of standby outcomes which were actually used by the player. All of this will be explained in more detail below.

In order to provide for tracking player history, data concerning a particular player may be stored in field 81 and bonus award data may be stored in field 80. In this manner, the lottery authority 11 can provide players with loyalty rewards such as free outcomes for total "tickets" purchased or the like.

Figure 4:
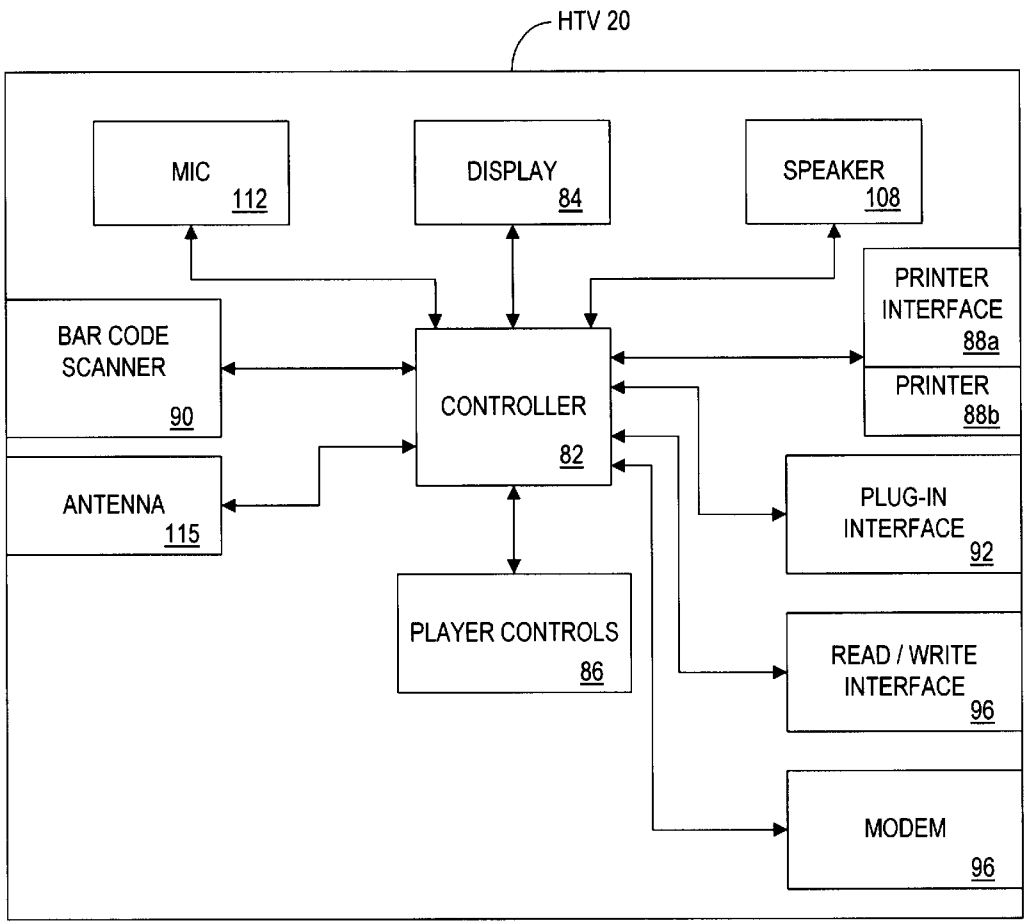
FIG. 4 is a block diagram of the components in an HTV.
Figure 5:
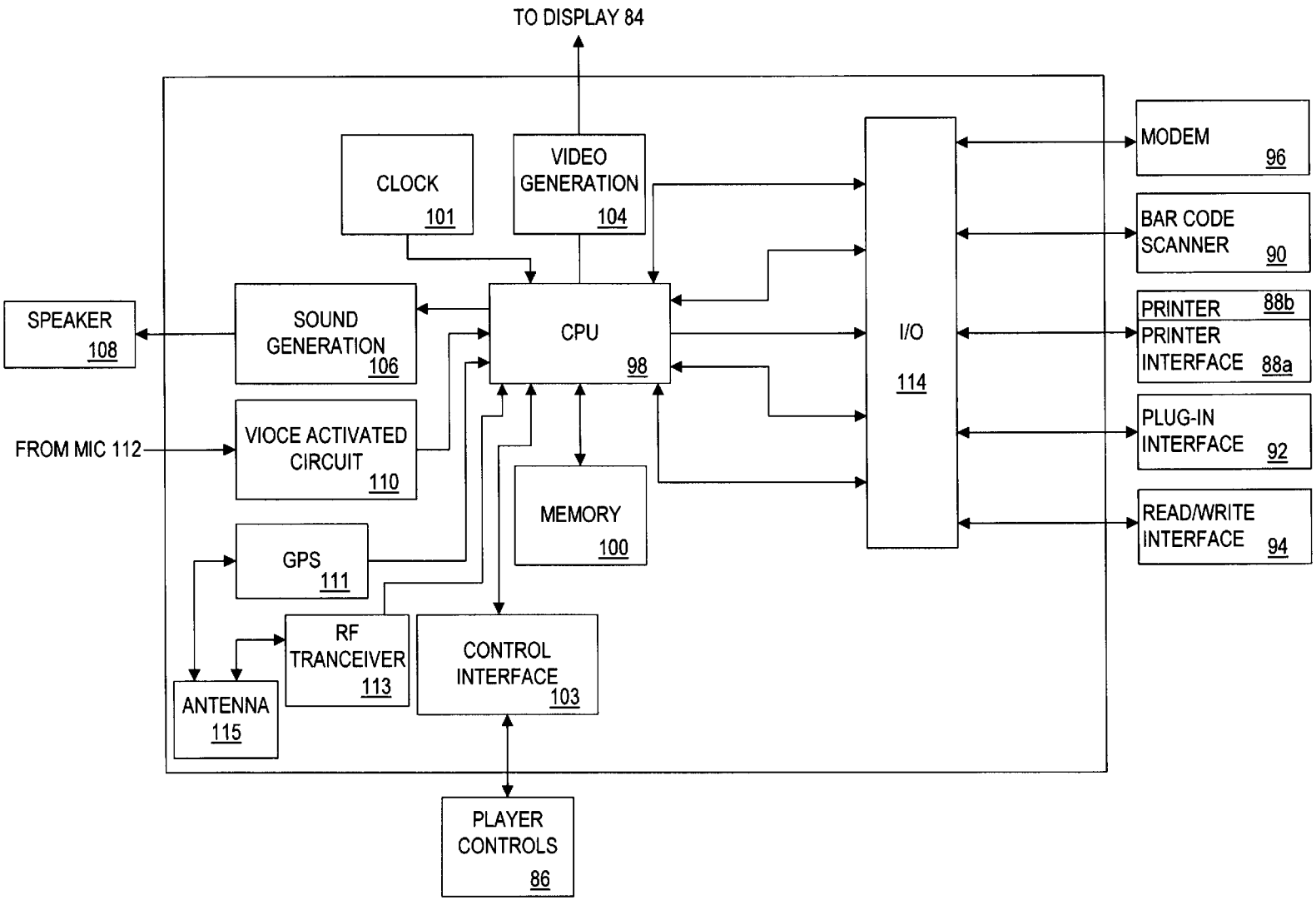
FIG. 5 is a block diagram of the controller in the HTV.

Referring now to FIGS. 4 and 5, the HTV 20 in a preferred embodiment is a hand-held unit having a controller 82, a display 84, and player controls 86. Preferably the HTV 20 includes one or more of the following: a printer interface 88*a* for connecting the HTV 20 to an external printer, an internal printer 88*b*, a bar code scanner 90, a communications interface 92 compatible for connecting the HTV 20 to the communications interface 26 associated with an AT 16 to enable the HTV 20 to electrically communicate directly with the AT 16, a read/write interface 94 for reading data from and writing data to smart card 28, a modem 96 for connecting the HTV 20 directly to a telecommunications network 14 coupled to the LCC 12 in an alternative embodiment shown in FIG. 12 and described below, and an antenna 115 coupled to a transceiver 113 for broadcasting and receiving messages to and from a base station 600 associated with LCC 12 in another alternative embodiment shown in FIG. 13 and described below.

The player controls 86 may be integrated into display 84 in a touch-screen arrangement of the type known in the art. The display 84 may also include the capability to render messages in a bar code readable format to enable them to be scanned by the bar code scanner 24 coupled to the AT 16. The player controls 86 allow the player to select various game, outcome transfer and redemption functions. The controller 82 includes a CPU 98, a clock 101 and memory 100 comprised of ROM and RAM in a conventional arrangement. The controller 82 may be optionally housed in a tamper-evident enclosure to reveal to the lottery authority 11 any suspected tampering with the device. The CPU 98 communicates with the player controls 86 through a control interface 103, and with video generation hardware 104 for driving the display 84, and sound generation hardware 106 coupled to a speaker 108 for communicating game sounds. A voice activated circuit 110 of the type known in the art may be coupled to a microphone 112 to enable messages to be communicated to the CPU 98 by spoken commands. The CPU 98 communicates with the printer interface 88*a* or the internal printer 88*b*, bar code scanner 90, interface 92, read/write interface 94, and modem 96 through conventional I/O interfaces shown generally in the block diagram at 114. The CPU 98 may communicate with RF circuitry 113 coupled to an antenna 115 for communicating messages directly with the LCC 12 via the base station as shown in the alternative embodiment in FIG. 13. In another application, the HTV 20 may have a GPS receiver 111 coupled to antenna 115 which communicates position information to the CPU 98. In this manner the HTV 20 can be prevented from operating unless it is located in a certain venue where gaming is permitted by a position enabling/disabling program in memory.

The outcome transfer message OTM may be communicated to the HTV 20 using the following protocols. In a first embodiment, the AT 16 prints the outcome transfer message OTM on a receipt 30 and the agent provides the OTM to the player. The player simply enters the outcome transfer message OTM into the HTV 20 using the player controls 86. Alternatively, the AT 16 may print the outcome transfer message OTM in a bar code readable format to enable the bar code scanner 24 to simply scan the same. In either case, the receipt can be printed without ink using a carbonless two-part form which the player tears off to prevent anyone else from viewing the outcome transfer message OTM and then trying to input it to another HTV 20. In an alternative embodiment, the HTV 20 can connect to the AT 16 at interface 92 and the outcome transfer message OTM may be communicated directly to the HTV 20. In another embodiment, the OTM may be written to memory in the smart card 28 through the read/write interface 27 connected to the AT 16. The player then plugs the smart card 213 into the HTV 20 and the OTM may be read by the HTV 20 from the smart card 28. In a further embodiment, the outcome transfer message OTM may spoken into the microphone 112, either by the player, the agent or by an automated voice over the telephone in a telephone embodiment shown in FIG. 12, and processed through the associated voice activated circuit 110. In another telephone embodiment, the HTV 20 may be connected to the telephone network 514 directly and the outcome transfer message OTM may be communicated to the HTV 20 through the modem 96. In the embodiment shown in FIG. 13, the outcome transfer message OTM may be communicated from the LCC 12 through an RF transmission from either the AT 16 or the LCC 12. Redemption request messages RRM from the HTV 20 to enable players to cash-out winnings may be similarly communicated.

Figure 6:
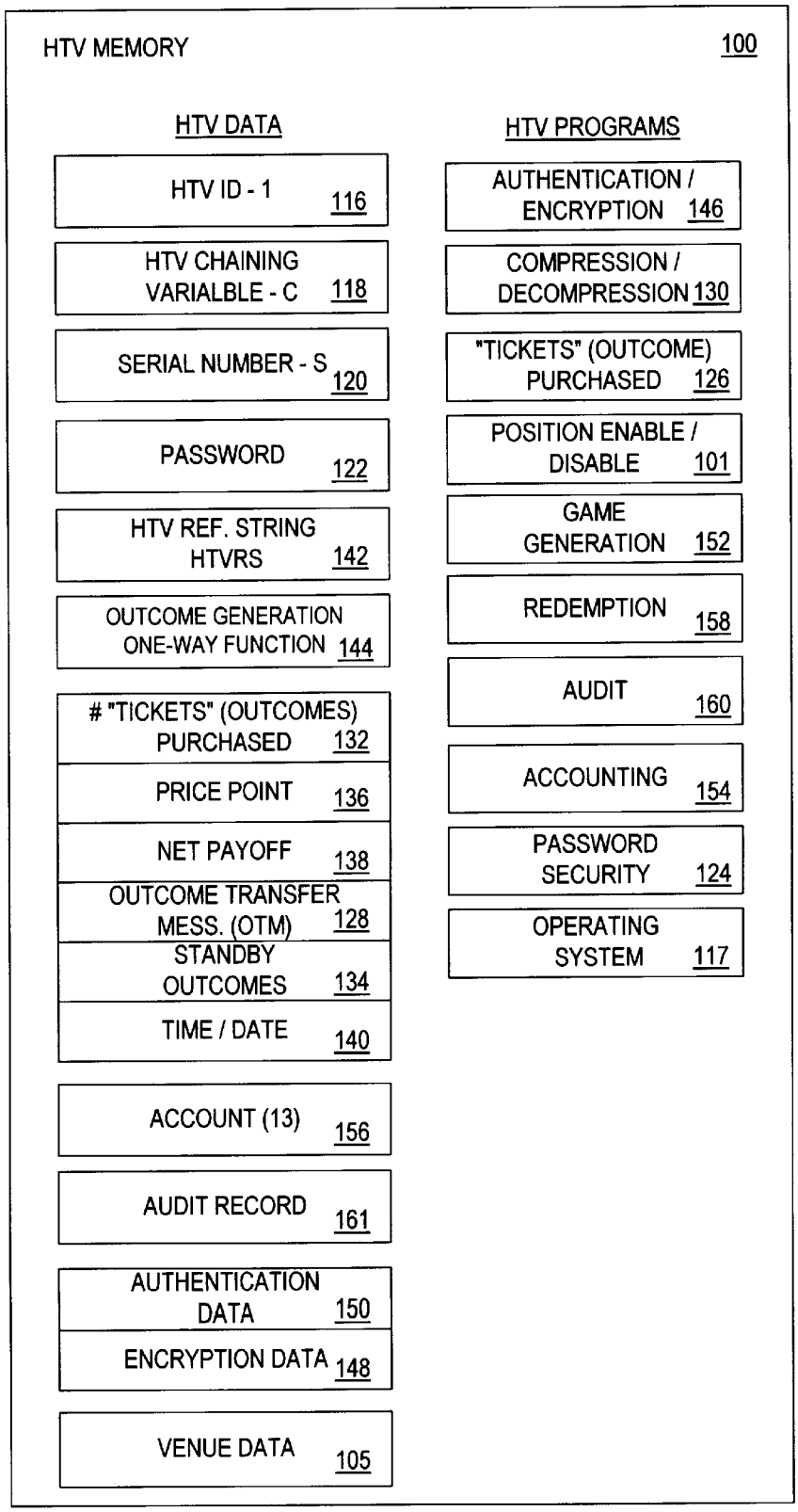
FIG. 6 is a diagram of an exemplary memory arrangement in the HTV.

Referring now to FIG. 6, there is depicted an exemplary memory arrangement 100 of programs and data in the HTV 20. Memory 100 includes an operating system generally indicated by the reference numeral 117 which controls the HTV 20 in a conventional manner. With respect to the present invention, the other programs and data in memory 100 enable the HTV 20 to read outcome transfer messages OTM from the LCC 12 and to process these messages in order to generate games which yield the outcomes. The HTV memory 100 may also include a position enable/disable program 101 which disables the HTV 20 when position information from the GPS receiver 111 indicates that the HTV 20 is located in a venue where gaming is impermissible. Information on gambling venues for use by the position enable/disable program may be stored in field 105. As described above with respect to the LCC memory 32, each HTV stores a unit identifier I in field 116 and optionally a chaining variable C in field 118. The HTV 20 may also store a serial number S in field 120. A password (or multiple passwords for multiple players on a single HTV 20) is stored in field 122. When a player activates the HTV 20, a password security program 124 checks the player's password in a conventional manner before allowing the player to continue. The HTV memory 100 further includes an outcome purchase program 126 which directs the HTV 20 to generate identification information to be transferred to the LCC 12, such as the outcome purchase request message OPRM, and to read the outcomes represented in the outcome transfer message OTM. When read by the HTV 20, the outcome transfer message OTM is stored in memory 100 in field 128. If the outcome transfer message OTM is compressed by the LCC 12, a compression/decompression program 130 is called by the outcome purchase program 126 to decompress the outcome transfer message OTM into the outcome sequence. The m outcomes $O_j \ldots O_{j+m}$ are stored in field 132. If there are x standby outcomes $O_s \ldots O_{s+x}$ assigned, these are stored in field 134. Accompanying this data may be the price point for each outcome in field 136, the net payoff in field 138, and the time/date of entry in field 140.

As described above with respect to the LCC 12, the outcome transfer message OTM may represent one or more memory addresses in a reference string HTVRS. Accordingly, each HTV 20 may store an HTVRS in field 142. In such an embodiment, the outcome purchase program 126 directs the HTV 20 to find the sequence of outcomes $O_j \ldots O_{j+m}$ or the net payoff on that sequence in the HTVRS.

Alternatively, the outcome transfer message OTM may represent a seed value for a one-way function in field 144. Thus, the outcome purchase program 126 directs the HTV 20 to generate the desired outcomes $O_j \ldots O_{j+m}$ using the one-way function. The same one-way function is stored in the LCC memory 32.

As described above, the outcome transfer messages OTM may be encrypted by the LCC 12 to prevent them from being used in another HTV 20. An authentication/encryption program 146 using algorithms of the type known in the art provides for the encryption and decryption of such messages communicated to and from the HTV 20. In this connection, the HTV 20 may store special keys for encrypting and decrypting such messages in field 148. Similarly, messages from the LCC 12 having message authentication codes may be authenticated by the authentication/encryption program 146 using keys known only to the LCC 12 and the particular HTV 20 stored in field 150. As described above with respect to the LCC memory 32, the chaining variable C which is unique to each HTV 20 may be used as a key to perform encryption/decryption and authentication.

The HTV 20 includes a game generation program ("game program") 152 which provides for the generation of various games and win/lose scoring on the display 84. The game generation program may also include a tutorial for teaching players how to play the games and a help function for each game. These games can be generated with each having either a win or lose outcome exactly corresponding to each outcome $O_j \ldots O_{j+m}$ represented by the outcome transfer message OTM. Thus, the game merely interprets or reveals the outcome. Alternatively, the games may be generated such that an m number of games have a net payoff equal to the net payoff in the series $O_j \ldots O_{j+m}$. The latter is not suitable for embodiments where standby outcomes are assigned as described below. A single game may have multiple chances but only one outcome. The game program 152 generates "no-choice" or non-skill games with a predetermined outcome such as, for example, the type commonly associated with pull-tab type instant lottery tickets, a sweepstakes, or bingo; or psuedo-choice games with a predetermined outcome such as video poker. In the case of the latter, the outcome for a particular poker game is predetermined with a maximum payoff which is recovered if the player plays every hand correctly. If the player plays incorrectly, the payout is less than the maximum represented by the outcome for a particular game. In addition, the game program 152 may generate games which are races of skill such as crossword puzzles or word descrambler games which must be completed within a specified period of time. If the player completes the game in the time allotted, the player is paid the predetermined payoff on the outcome selected for that game. If not, a win is not credited to the HTV account 155 described below. Programs for generating such games are known in art. The game program 152 can be designed to require a game identifier such that the lottery authority 11 selects which games are to be played in connection with any outcomes that are sold. In this regard, the outcome transfer message OTM may include an instruction for the game program 152 to generate a specific game for those outcomes. In order to provide for updating games in the HTV 20, new game programs could be loaded into memory 100 in a conventional manner through the smart card 28 or by plugging the HTV 20 into the AT 16 as described above and then uploading the appropriate software instructions.

The HTV memory 100 also includes an accounting program 154 which directs the HTV 20 to calculate the running cash balance which is stored in an account 155 in field 156. If there are several players assigned to a given HTV 20, there may be individual accounts for each player.

The HTV memory further includes a redemption program 158 which is used to cash-out the player's current credit balance in the player's account 155. The redemption program 158 enables the player to select a cash-out function on the HTV 20. The redemption program 158 then directs the HTV 20 to generate a redemption request message RRM which is communicated to the LCC 12 using methods similar to the way in which outcome transfer message OTM was communicated to the HTV 20, but in reverse. Redemption request messages RRM are used by the redemption program 79 in the LCC 12 to verify cash-out requests by comparing HTV identification data and outcome data (net winnings, the number of games played) for a given HTV 20. The redemption request message RRM may be generated on the display 84 of the HTV 20 and orally provided to the agent at a lottery retailer 18 for manual entry into the AT 16. The redemption request message RRM can be printed onto a receipt 30, either by an internal or external printer **88*b* associated with the HTV 20, or by a printer 22 at the lottery retailer via the printer interface 88*a*, which receipt 30 is then provided to the agent. In this connection, the redemption request message RRM may be rendered on the display 84 or on the receipt 30 in a bar code readable format and scanned by the bar code scanner 24 at the AT 16. In another embodiment, the redemption request message RRM may be written to the smart card 28 and then read therefrom by the AT 16. In yet another embodiment, the redemption request message RRM can be communicated to the LCC 12 over the telephone network 14 via the modem 96. In still another embodiment, the redemption request message RRM may be communicated from the HTV 20 to the LCC 12 through an RF transmission to either the AT 16 or the LCC 12. The redemption request message RRM may be encrypted by the HTV 20 using the authentication/encryption program 146 in memory 100 for subsequent decryption by the LCC 12 using the authentication/encryption program 68 in memory 32. The redemption request message RRM can be encrypted using encryption keys known only to the LCC 12 and the specific HTV 20**. These may include the unit identifier I and the chaining variable C.

The HTV memory 100 also includes an audit program 160 which stores a record of all activity performed on the HTV 20 in field 161 to assist in protecting data integrity and to verify that the various programs in memory 100 have not been tampered with. The audit program 160 further provides a record of player activity for the player and the lottery authority 11 in the event of any dispute.

Figure 7A:
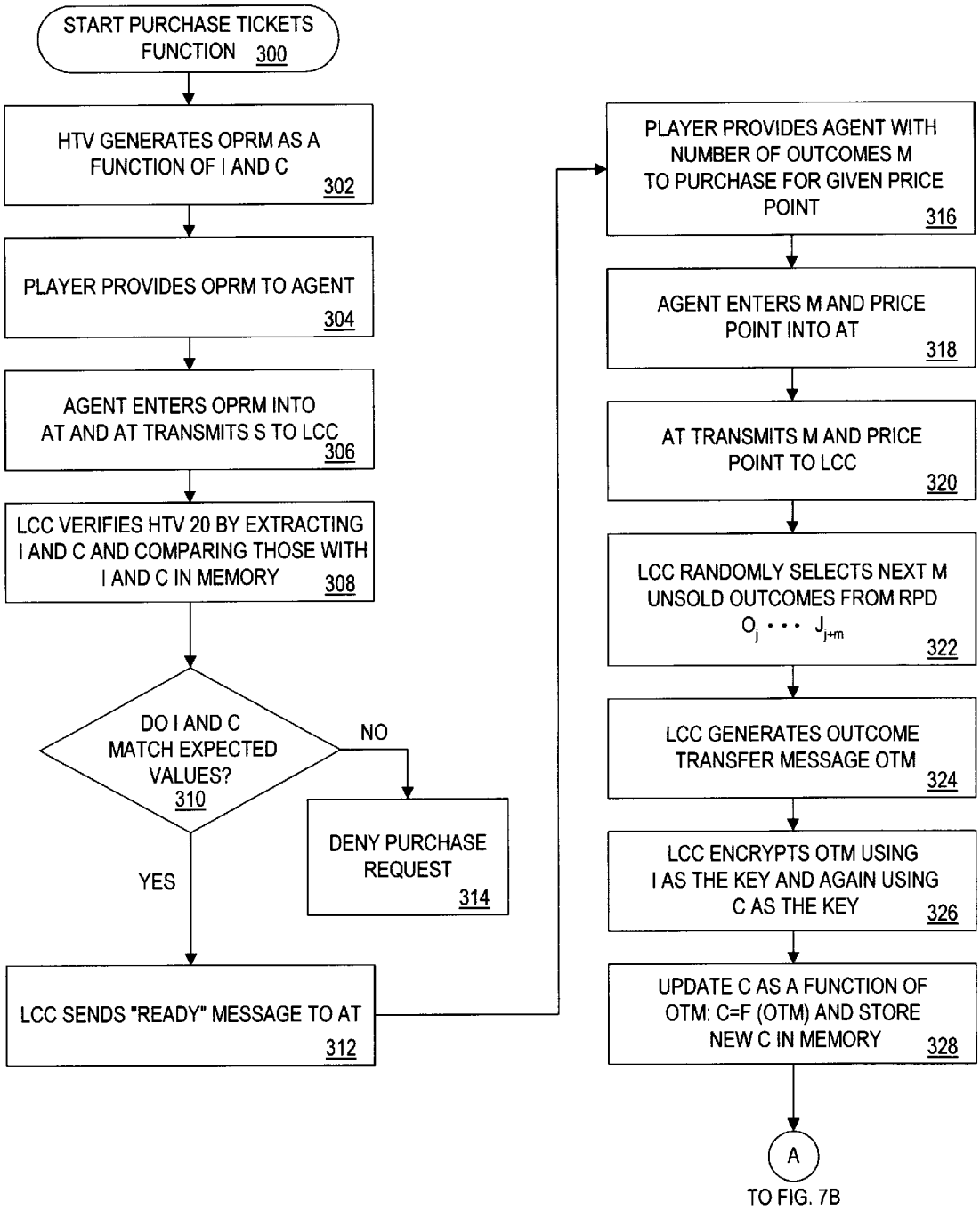
FIGS. 7A and 7B are a flow chart of an exemplary outcome purchase.
Figure 7B:
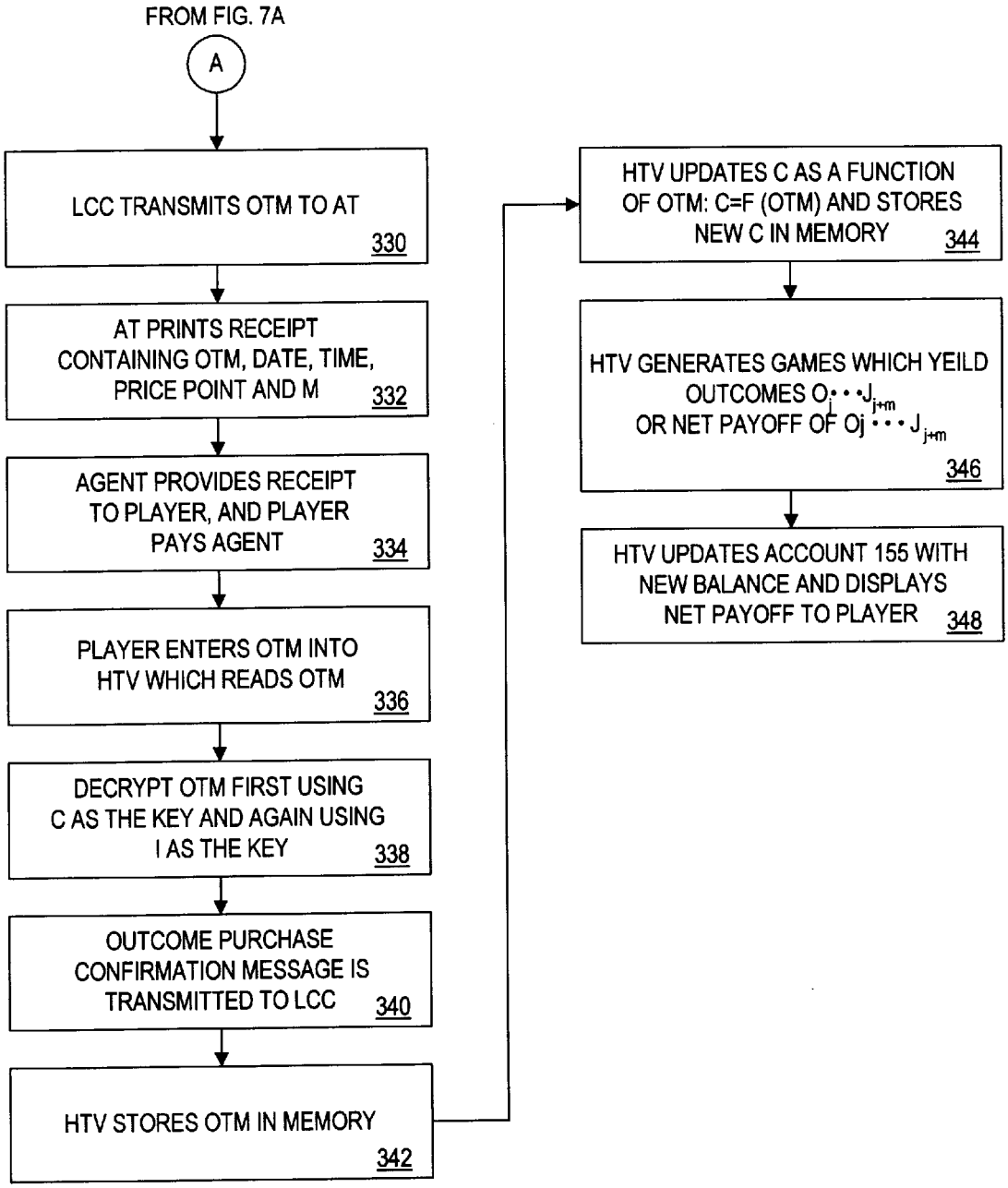

Referring now to FIGS. 7A and 7B, there is shown a flowchart of an exemplary outcome purchase of m "tickets" (outcomes) from the LCC 12 through an AT 16 at a lottery retailer 11. For convenience, the following assumes all outcomes are purchased at a single price point. However, the outcomes purchased from the RPD 44 may represent different price points and may be purchased separately by obtaining an outcome transfer message for each price point, or together by generating an outcome transfer message OTM which represents outcomes having different price points. To begin the purchase sequence, the player first activates the HTV 20 and enters his or her password which is checked by the password security program 124. The player then selects the purchase "ticket" function at step 300. The outcome purchase program 126 directs the HTV 20 to generate an outcome purchase request message OPRM as a one-way function of I and C at step 302. The player provides the OPRM to the agent at the lottery retailer 11 at step 304. The agent then enters the OPRM into the AT 16 which transmits the OPRM to the LCC at step 306. The serial number OPRM could also have been provided to the agent by any of the above described methods of communicating an outcome transfer message OTM or a redemption request message RRM as described above. The LCC 12 runs its outcome purchase program 48 at step 308 which extracts I and C from S for that HTV 20. At step 310, the LCC compares I and C with the values for I and C stored in fields 37 and 38, respectively, in the HTV memory area 36 for that HTV 20. As described above, I and C are initially stored in the LCC 12 when the particular HTV is registered with the lottery authority 11. C for a given HTV 20 is updated using a one-way function every time outcomes are transferred to that HTV 20. If I and C match, then the LCC 12 sends a ready code to the AT 16 at step 312. If not, then the LCC 12 denies the outcome purchase request because the HTV 20 is not registered or has been altered in some way at step 314. If the HTV identification is valid, the player then provides the agent with the number of outcomes m to be purchased for a given price point at step 316. The agent enters m and the price point into the AT 16 at step 318. The AT 16 transmits m and the price point to the LCC at step 320. The outcome purchase program 48 in LCC memory 32 then randomly selects the next m unsold outcomes $O_j \ldots O_{j+m}$ for that price point from the RPD 44 at step 322. It also directs the LCC 12 to store the outcomes $O_j \ldots O_{j+m}$ in field 52, the price point in field 56, the net-payoff in field 58 and the time/date in field 60. The LCC 12 then generates an outcome transfer message OTM at step 324 using any one of the methods described in the foregoing. The LCC 12 can also store the outcome transfer message OTM for the given purchase in memory in field 50. As discussed in the foregoing, the LCC 12 can use the authentication/encryption program 68 to encrypt the outcome transfer message OTM, in this example first using I as an encryption key and then using C as an encryption key at step 326 (the OTM need not be encrypted, it could be made authenticatable by appending message authentication codes which are authenticated in the HTV 20 by keys known only to the LCC 12 and the HTV 20). It then updates C as a one-way function of the outcome transfer message—C=f(OTM), and stores the new value for C in field 38 at step 328. The LCC 12 then transmits the outcome transfer message OTM to the AT 16 at step 330. The AT prints a receipt 30 containing the OTM, the date, time, price point and m at step 332. The agent then provides the receipt 30 containing the outcome transfer message OTM to the player, and the player pays the agent at step 334. At this time, an outcome purchase confirmation message is communicated from the AT 16 to the LCC 12 at step 336 which indicates that the player has "irrevocably" purchased the outcomes represented by the outcome transfer message OTM. The player then enters the outcome transfer message OTM into the HTV 20 at step 338. The HTV 20 runs the authentication/encryption program 146 to decrypt the outcome transfer message OTM first using C as the key and again using I as the key at step 340. The outcome transfer message OTM is then stored in field 128 in HTV memory 100 at step 342. If the outcomes are simply compressed into a sequence $O_j \ldots O_{j+m}$ (FIG. 9), the decompression/compression program 130 will decompress the sequence and store the same in field 132. The outcome purchase program 130 may also store the price point in field 136, and net payoff in field 138. If the outcome transfer message OTM represents an address in the HTVRS, the outcome purchase program 130 will search the HTVRS stored in field 142 for that address or an address where a series of outcomes reside with the same net payoff as $O_j \ldots O_{j+m}$. If the outcome transfer message OTM represents a seed value for a one-way function stored in field 144, the outcome purchase program 130 will use the seed value to generate the same series of outcomes $O_j \ldots O_{j+m}$. Alternatively, the outcome transfer message OTM may simply represent the net-payoff on a number of m outcomes $O_j \ldots O_{j+m}$ in which case the game program 152 generates a number of games with the same net payoff. Once the outcome message OTM has been stored in step 342, the outcome purchase program 126 updates C as a one-way function of OTM and stores the new value for C in field 118 at step 344. Thus, both the HTV 20 and the LCC 12 have new values for C stored in memory. The player then plays games on the HTV 20 generated by the game program 152 which yield the outcomes $O_j \ldots O_{j+m}$ or the net payoff on those outcomes at step 346. The player's account balance is updated by the accounting program 154 as each outcome is revealed and stored in account 155 in field 156 at step 348.

Figure 8:
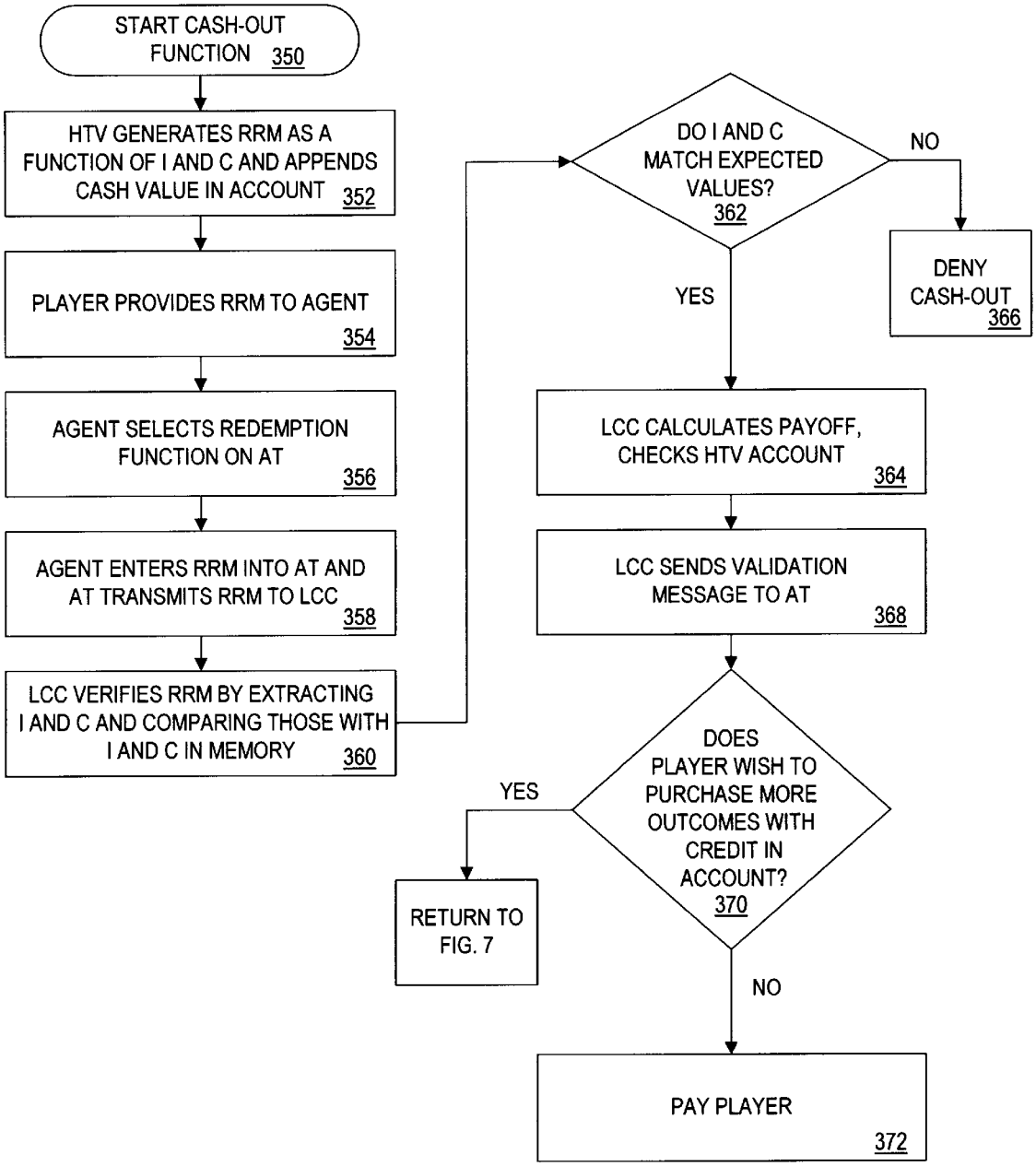
FIG. 8 is a flow chart of an exemplary redemption sequence.

FIG. 8 is an exemplary cash-out sequence in the embodiment described above. Essentially, the HTV 20 identifies itself to the LCC 12 and the LCC 12 authorizes a payoff on the outcome sequence $O_j \ldots O_{j+m}$ sold to that HTV 20. To begin the redemption sequence, the player first activates the HTV 20 and enters his or her password which is checked by the password security program 124 as described above. The player then chooses the cash-out function at step 350. The redemption program 158 in HTV memory 100 generates the redemption request message RRM, in this example, as a function of I and C at step 352. Thus, the redemption request message RRM is similar to the outcome purchase request message OPRM described in the outcome purchase sequence of FIGS. 7A and 7B. The RRM may also include the updated cash balance in account 155 which represents the payoff on the outcomes which were revealed. The value for C was updated as a one-way function of the outcome transfer message OTM at step 344 above. The value for C was also updated in the LCC memory 32 at step 328 above. The player provides the redemption request message RRM to the agent at step 354. The agent then activates a redemption function on the AT 16 at step 356. The agent enters the redemption request message RRM into the AT 16 which transmits the RRM to the LCC 12 at step 358. The LCC 12 then runs the redemption program 79 which verifies the redemption request message RRM by extracting I and C and comparing the values for I and C with the values stored in memory 32 in fields 37 and 38, respectively, at step 360. If I and C do not match the expected values at step 362, the LCC 12 denies the cash-out request at step 364. If I and C match the expected values at step 362, then at step 364 the LCC 12 checks the cash balance embodied in the redemption request message RRM against the amount it calculated (the payoff stored in field 58 for that outcome sequence) as a result of the sale of the outcomes to the HTV 20 and stored previously in the HTV account 73 in field 74. The LCC 12 then sends a validation message to the AT 16 at step 368 and the amount is debited in account 73. The player may opt to purchase more outcomes with the present cash balance in account 73 at step 370, in which case the outcome purchase sequence shown in FIG. 7 may be repeated. Alternatively, the player is paid by the agent at step 372.

Figure 9:
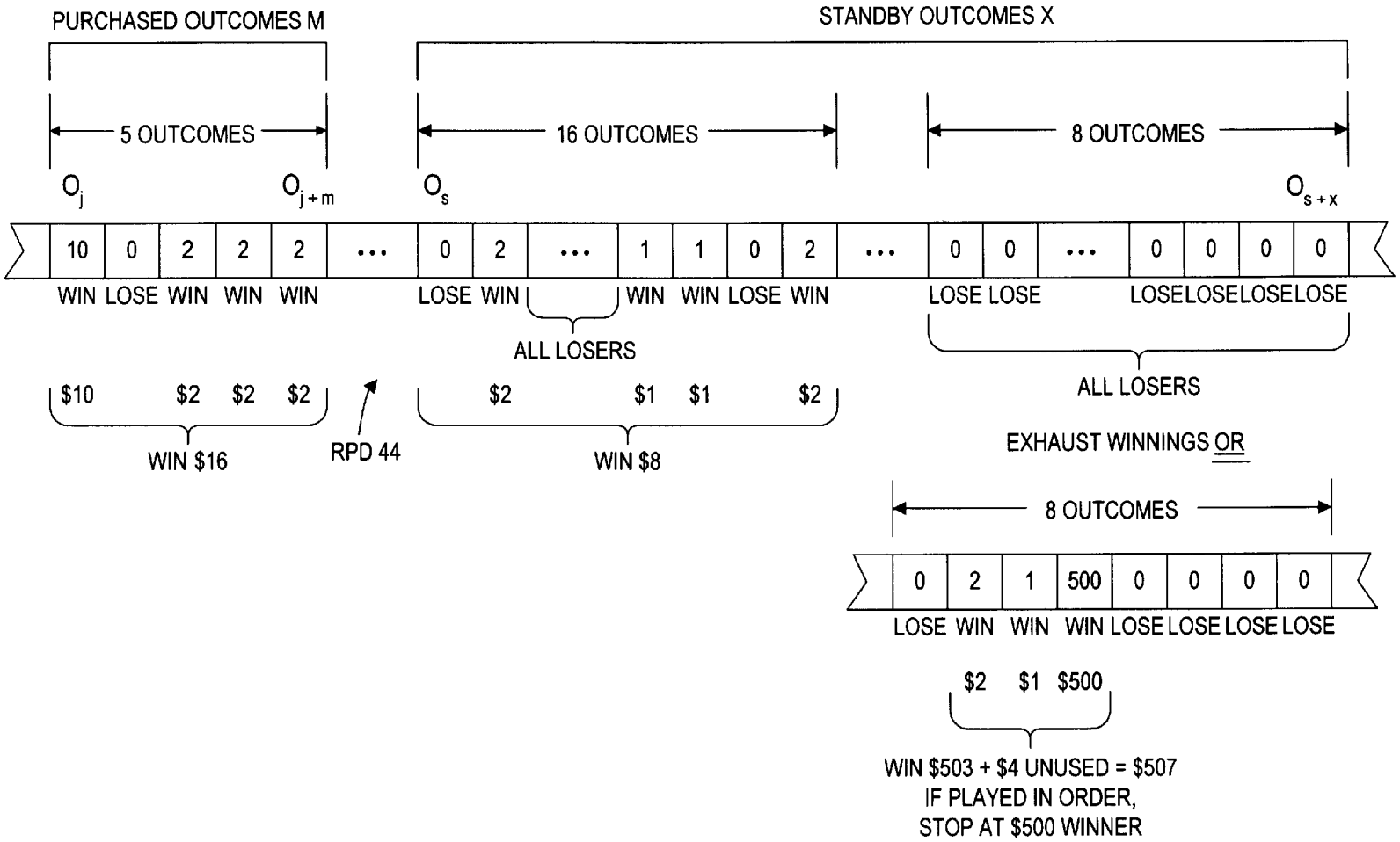
FIG. 9 is a schematic of a random prize datastream showing an example of purchased and standby outcomes.

As described briefly above, an outcome purchase request for m outcomes $O_j \ldots O_{j+m}$ may be accompanied by x standby outcomes $O_j \ldots O_{j+m}$. The standby outcomes are supplied in a number sufficient to exhaust all winnings, or so as to generate a large win at some point in the sequence above a predetermined value where the outcome purchase program 126 in the HTV 20 will direct the HTV 20 to stop generating games and provide a cash-out instruction on the display 84. Referring now to FIG. 9, there is shown a portion of an RPD 44 with five (5) purchased outcomes $O_j \ldots O_{j+m}$. which have a net-payoff of $16. In this example, the outcome purchase program 48 in the LCC 12 has selected twenty four (24) standby outcomes $O_s \ldots O_{s+x}$ in two groups as shown. The standby outcomes can be selected from anywhere in the RPD 44 but the groups are played in order. The relative positions between the purchased outcomes m and the standby outcomes x shown in the RPD 44 are merely exemplary. For the purpose of this example, all outcomes are purchased for $1. The player wins $16 on the purchased outcomes $O_j \ldots O_{j+m}$. If the player spends that $16 on the first group of sixteen (16) standby outcomes and those outcomes yield a net payoff of $8, the next group may constitute eight (8) outcomes which yield a net payoff of zero (0) in the first example (full exhaustion of winnings) or some large prize (e.g., $500) represented by the fourth outcome in the order shown in the second example for the second group. Referring to the second example, if the outcome sequence in the second group is played in order, and the sequence of outcomes is lose, win $2, win $1, win $500, the player retains $4 in winnings after the first standby group is played and $2+$1+$500 in the second group for a net win of $507. The game program 152 in the HTV 20 will direct the HTV 20 to generate a cash-out message when such a large outcome is revealed. If there are any remaining standby outcomes, in this example four losers, these will be voided in the HTV 20 by the redemption program 158. Similarly, those four standby outcomes will be voided in the LCC 12 when the LCC 12 is provided with a redemption request message RRM which represents all outcomes transferred to that HTV 20, including the m purchased outcomes, and the x standby outcomes. Since the player may choose to cash-out at some time during the sequence before all standby outcomes are revealed, the redemption request message RRM generated by the HTV 20 represents which standby outcomes were revealed by the HTV 20 and enables the LCC 12 to compute the proper payoff and to void any unused standby outcomes in the LCC 12.

Figure 10A:
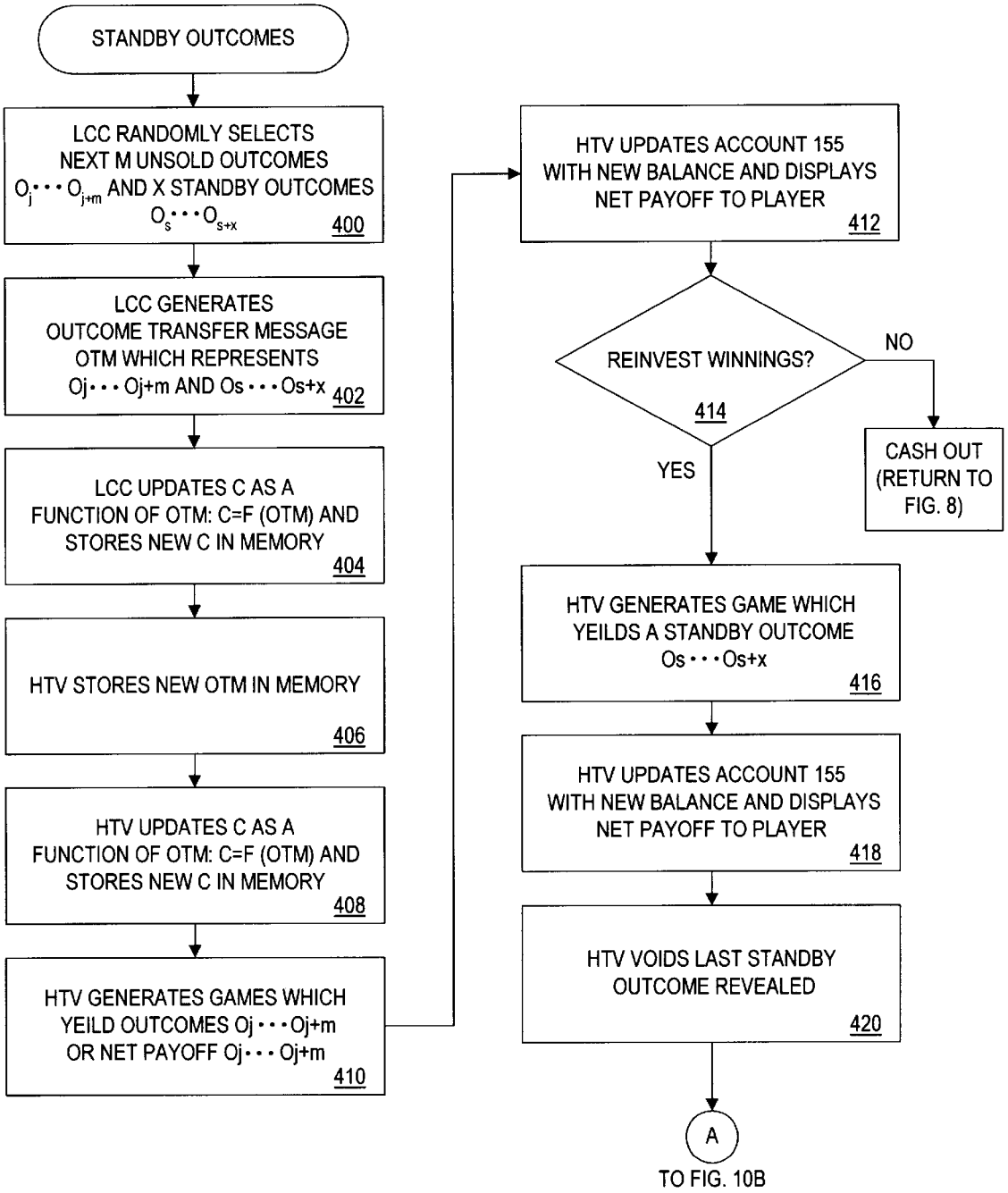
FIGS. 10A and 10B are a flow chart of an exemplary outcome purchase sequence with standby outcomes.
Figure 10B:
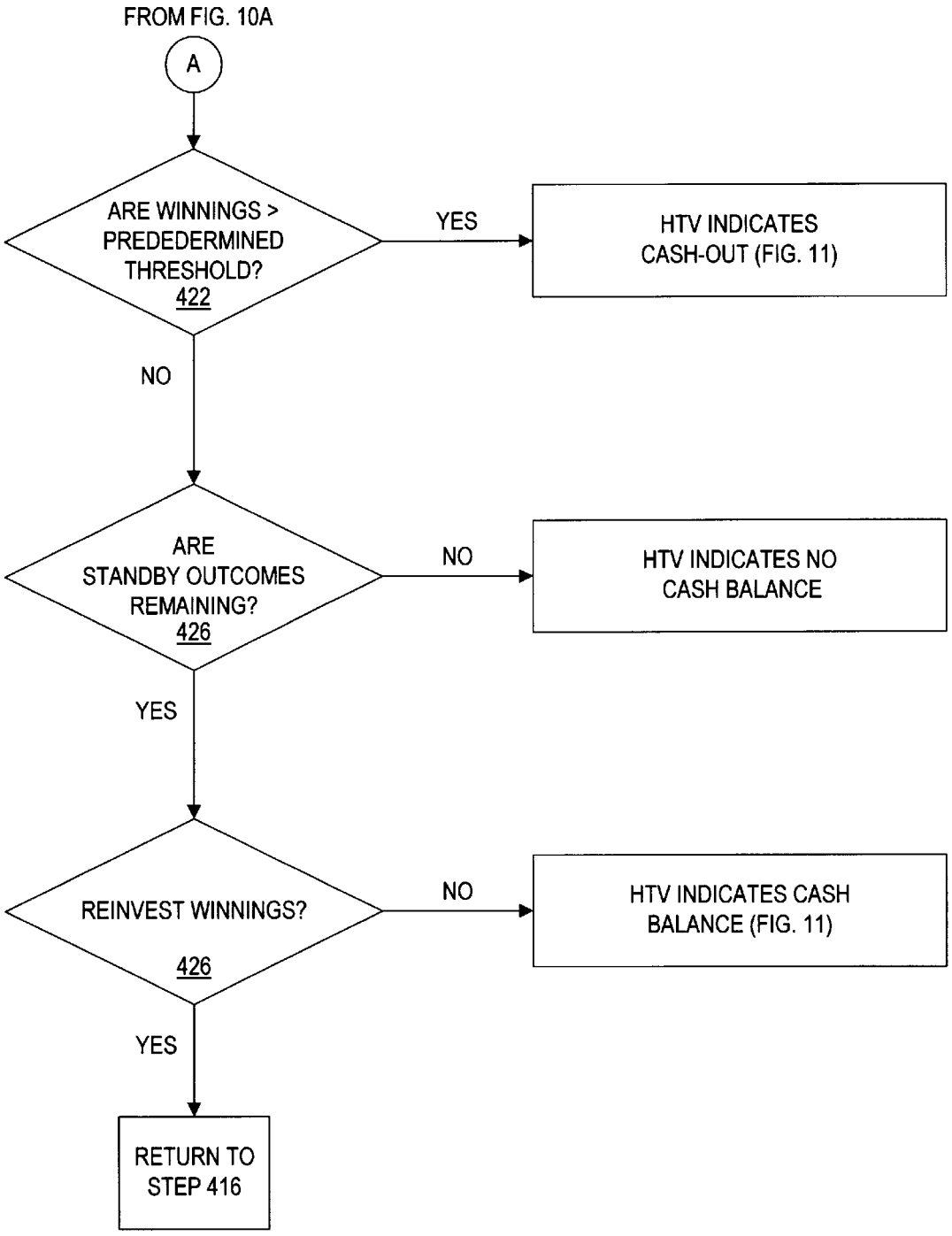

Referring now to FIGS. 10A and 10B, there is shown an exemplary flowchart of an outcome purchase sequence including m purchased outcomes $O_j \ldots O_{j+m}$ and x standby outcomes $O_s \ldots O_{s+x}$. The protocol in the example is similar to what happens in FIG. 7, so redundant steps will not be repeated. At step 400, the outcome purchase program 48 in LCC memory randomly selects m purchased outcomes $O_j \ldots O_{j+m}$ and x standby outcomes $O_s \ldots O_{s+x}$ from the RPD 44. The LCC 12 then generates an outcome transfer message OTM representing the m outcomes and x standby outcomes at step 402. The outcome transfer message may consist of a compressed sequence, address for outcomes in the HTVRS or a seed value for a one-way function as described above. The LCC 12 can update C as a function of the outcome transfer message OTM and store the same in memory as described above at step 404. Once the outcome transfer message OTM has been read and authenticated (if authenticatable) or decrypted (if encrypted), it is stored in memory 100 in field 128 in the HTV 20 at step 406. In this regard, the m outcomes $O_j \ldots O_{j+m}$ may be stored in field 132 and the standby outcomes $O_s \ldots O_{s+x}$ may be stored in field 134 of the HTV memory 100. The same data has been stored in the LCC memory 32. At step 408, the HTV updates C as a one-way function of OTM. The HTV 20 then generates games which yield the m outcomes $O_j \ldots O_{j+m}$ or the net payoff on those outcomes at step 410. The HTV 20 utilizes the accounting program to update the cash-balance in account 155 at step 412. Up to this point, the protocol is generally the same as shown in FIG. 7. At step 414, the outcome purchase program 126 directs the HTV 20 to display the option to reinvest the cash-balance (winnings) in account 155. If the player wishes to cash-out, the cash-out sequence in FIG. 7 may be followed. If the player wants to reinvest, the game program 152 will generate a game which yields a standby outcome in $O_s \ldots O_{s+x}$ at step 416. The accounting program 154 in the HTV 20 updates account 155 with a new cash-balance and displays the updated balance to the winner on the display 84, depending upon whether the standby outcome was a winner or loser at step 418. The outcome purchase program 126 then voids the last standby outcome revealed at step 420 and updates the status (to "revealed") of that outcome in the sequence of standby outcomes stored in field 54. If the last standby outcome revealed generates a large prize over some predetermined threshold at step 422, the outcome purchase program 48 directs the HTV 20 to display a message to the player that he or she must cash-out at step 424. The player goes through the redemption sequence in FIG. 11. If not, the outcome purchase program 48 checks to determine whether there are any unused standby outcomes remaining in field 54 at step 426. If not, the player has exhausted the cash-balance in account 155 and the HTV 20 generates a zero cash-balance on the display 84 at step 428. If standby outcomes remain, the player chooses whether to continue to reinvest at step 430. If the player selects reinvestment, the HTV 20 will generate another game which yields the next standby outcome at step 416. If the player elects to cash-out, the HTV 20 indicates the cash-balance in account 155 at step 432 and the player goes through the redemption sequence in FIG. 11.

Figure 11:
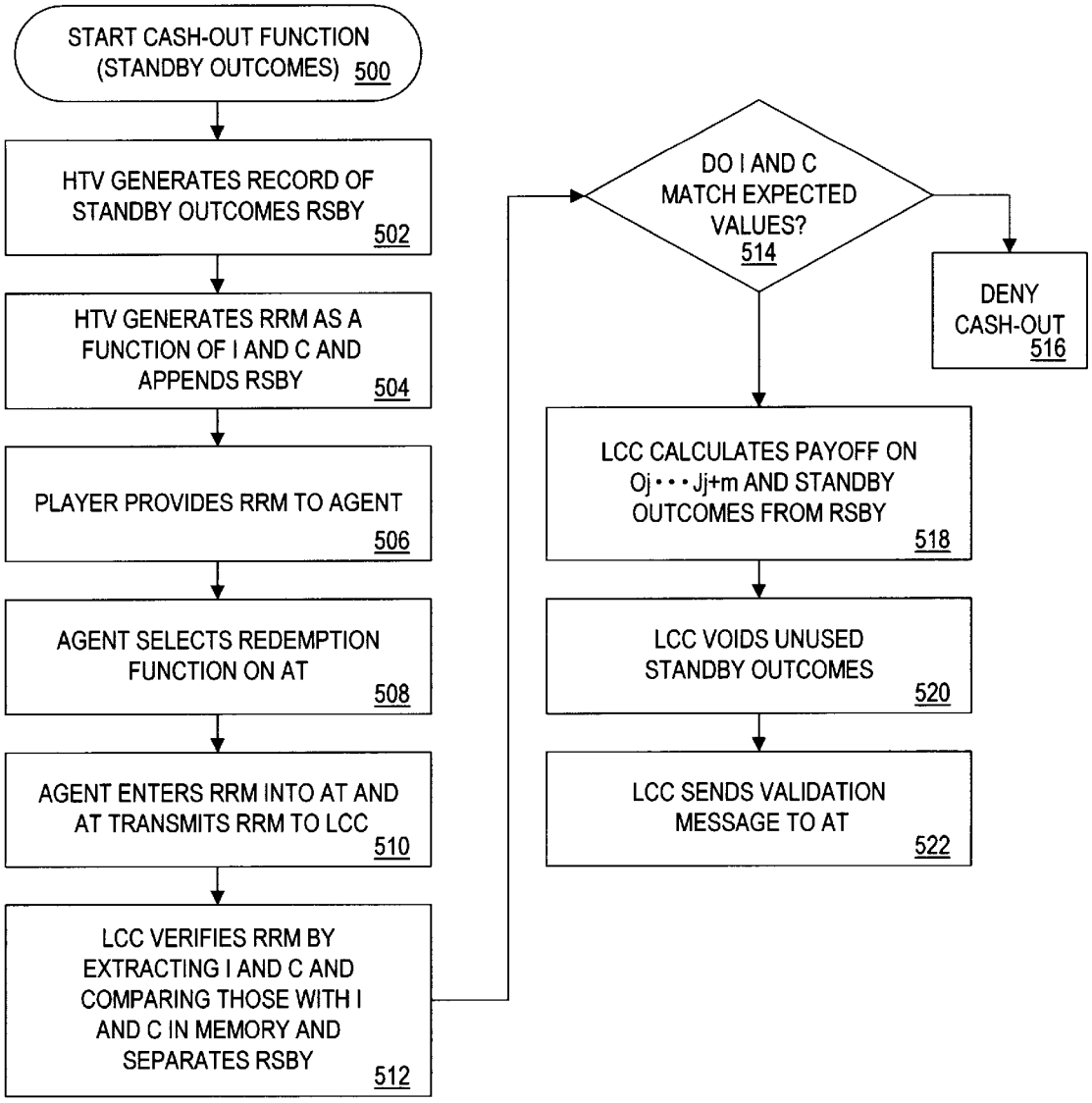
FIG. 11 is a flow chart of an exemplary redemption sequence with standby outcomes.

Referring now to FIG. 11, there is shown an exemplary cash-out sequence when there are standby outcomes. To begin the redemption sequence, the player first activates the HTV 20 and enters his or her password which is checked by the password security program 124 as described above. The player initiates the cash-out function at step 500. The redemption program 158 in HTV memory 100 generates a status record of the standby outcomes and the accompanying cash balance in account 155 RSBY at step 502 and a redemption request message RRM as a function of I and C which appends RSBY at step 504. The redemption program 79 also voids any unused standby outcomes stored in field 54. The redemption request message RRM may be compressed by the decompression/compression program 146 in HTV memory 100 into a smaller message since the record of standby outcomes may be lengthy if the RRM is to be displayed on the HTV display 84 or printed out on a receipt 30 (either in alphanumeric form or in a bar code readable format). This example describes an embodiment where the player provides the redemption request message RRM to an agent at the lottery retailer 18 at step 506. As described above, the redemption request message may be communicated to the AT 16 through other methods. The agent selects a redemption function on the AT 16 at step 508. The agent then enters the redemption request message RRM into the AT 16 and the AT 16 communicates the redemption request message RRM to the LCC 12 at step 510. The LCC then runs the redemption program 79 to verify the redemption request message RRM by extracting RSBY, I and C and comparing the values for I and C with those stored in memory 100 in fields 37 and 38, respectively, at step 512. If I and C do not match the expected values at step 514, the LCC 12 denies the cash-out request at step 516. If I and C match the expected values at step 514, then the LCC 12 uses the accounting program 154 to calculate the payoff on the standby outcomes represented in RSBY and credits the HTV account 155 in field 156. The LCC 12 then voids any unused standby outcomes represented in the RSBY at step 520. The LCC 12 then sends a validation message to the AT 16 at step 522.

Figure 12:
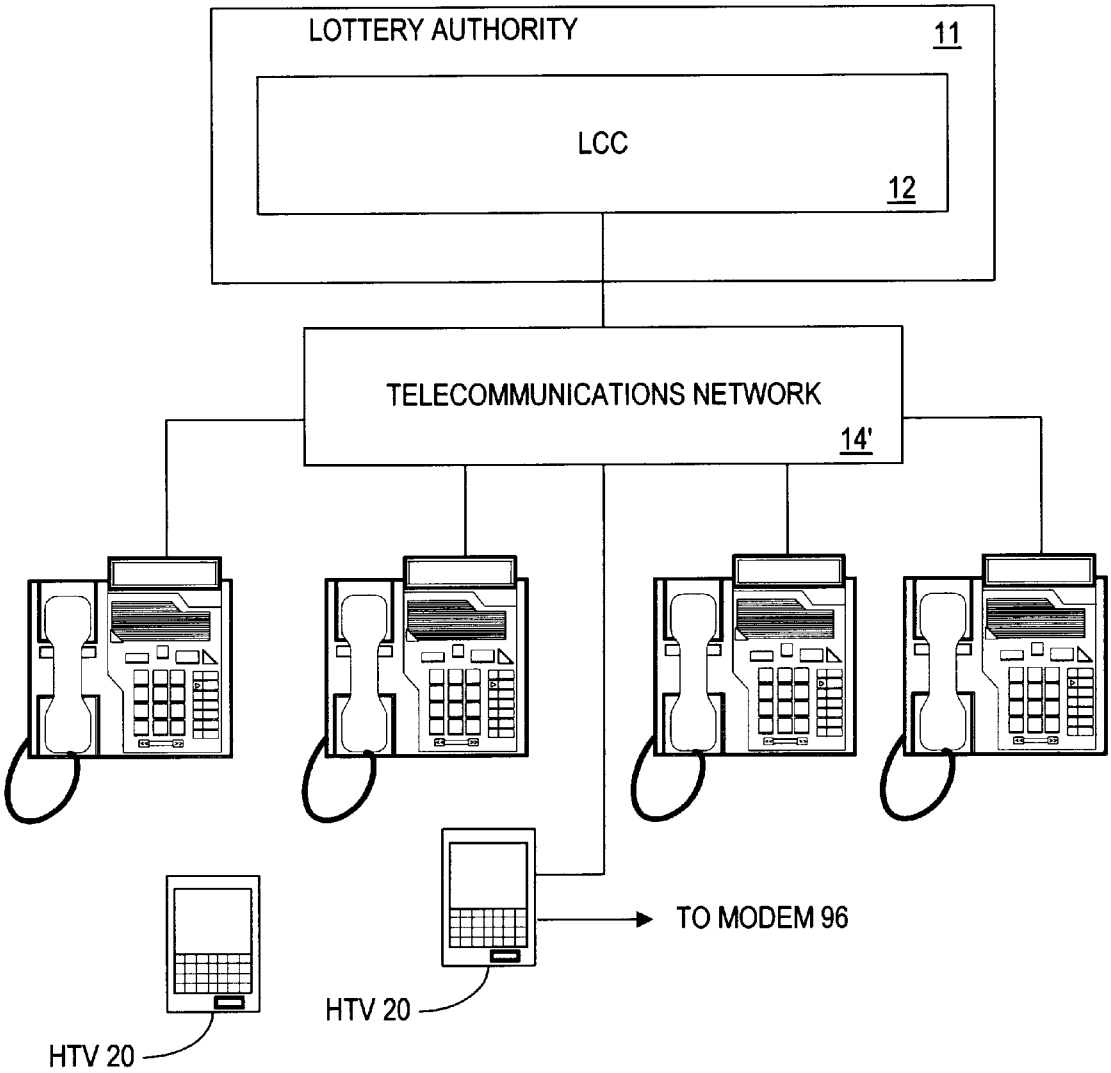
FIG. 12 is a schematic of an alternative embodiment of the invention.

Referring now to FIG. 12, an LCC 12 is coupled to a telecommunications network 14' having interactive voice capability and is accessible by dialing a 900 number or the like to enable the outcome purchase and redemption to be effectuated over the telephone 13. Alternatively, the telecommunications network 14' may be any interactive communications network, including the Internet. The protocol is similar to that described above with regard to purchase and redemption at an AT 16, except here the player simply keys the information into the telephone 13 in response to prompts from the system. Thus, the player first communicates the HTV identification information in the form of an outcome purchase request message OPRM to the LCC 12. If HTV identification/registration is confirmed, the LCC 12 then provides a "ready" indication to the player with instructions to select the number of outcomes to be purchased for each price point. The LCC 12 then generates an outcome transfer message OTM as described above which the player manually keys into the HTV 20. The system operates Similarly to redeem winnings. The HTV 20 generates a redemption request message RRM, and the player keys the redemption request message into the telephone. The redemption request message RRM is communicated to the LCC 12, which verifies the identity of the HTV 20 and the expected payoff. A credit is then made to an account for the HTV/player in the LCC 12. In a modification of this embodiment, the HTV 20 contains a modem 96 which enables it to communicate directly over the telecommunications network 14' to communicate outcome transfer messages OTM from the LCC 12 to the HTV 20 and redemption request messages RRM from the HTV 20 to the LCC 12. Alternatively, the HTV 20 may incorporate a cellular phone (not shown) for the same purpose. This embodiment is still considered to be an off-line arrangement as there is no need to have an on-line connection between the HTV and the LCC during play.

Figure 13:
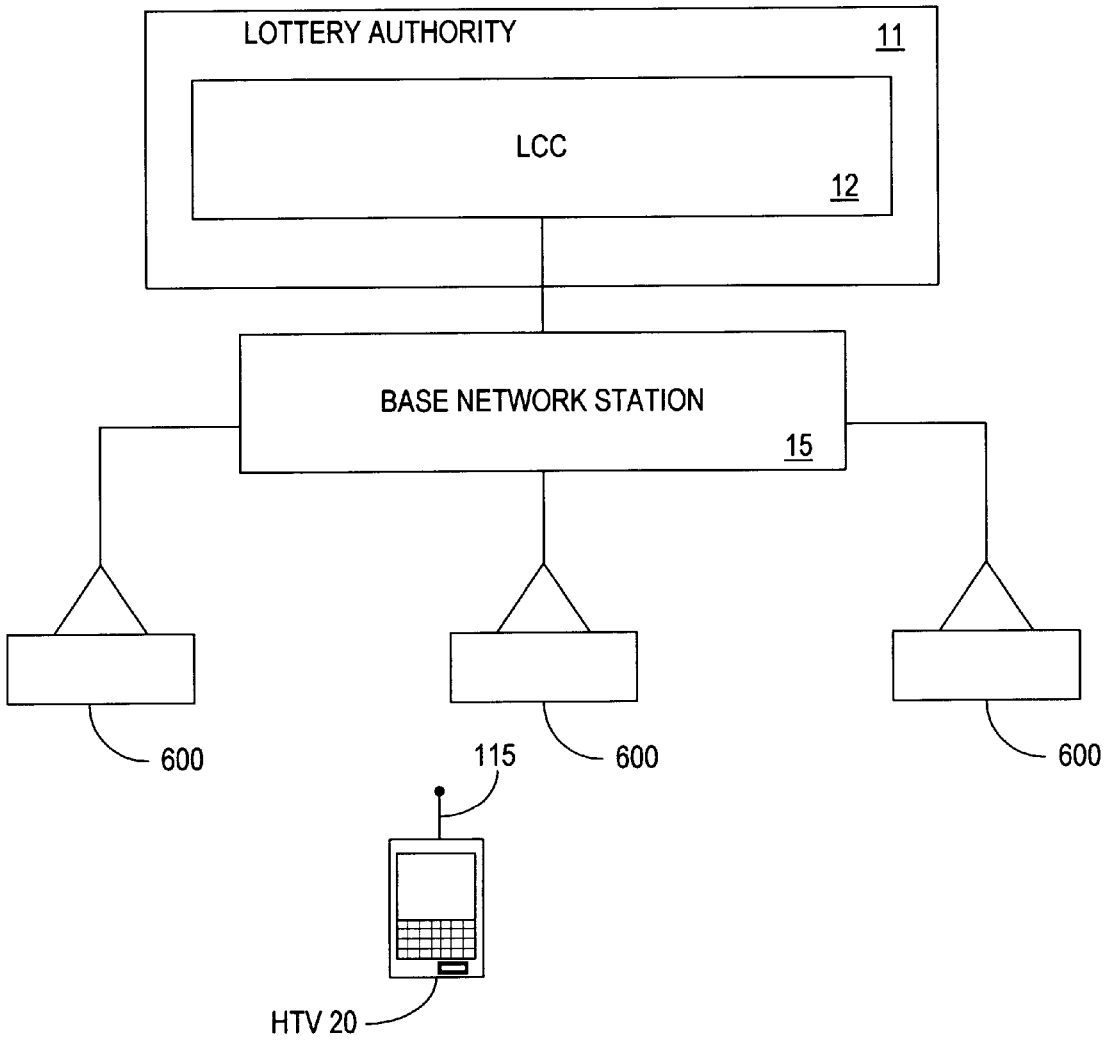
FIG. 13 is a schematic of another alternative embodiment of the invention.

In a further embodiment shown in FIG. 13, the LCC 12 communicates through a base station network 15 with a plurality of base stations 600 for broadcasting and receiving RF messages. The HTV 20 also includes a transceiver 113 for broadcasting and receiving RF communications such that all purchase and redemption functions may be implemented without the need for the player to travel to a lottery retailer. The protocol is similar to that described above with respect to the other embodiments.

We claim:

1. A remote lottery system which enables a player to purchase outcomes from a randomized prize datastream in a central computer and view the outcomes on at least one device which is not in electronic communication with the central computer during play, comprising:

a central computer including a processor and a central computer memory, said central computer memory operative to store a randomized prize datastream comprised of a finite series of random win/lose outcomes and identification data for at least one remotely disposed gaming computer, said central computer further including assignment means responsive to an outcome purchase request by a player for assigning a requested number of outcomes from said randomized prize datastream to said at least one remotely disposed gaming computer, and for storing a record representative of said purchased outcomes with said identification data for said at least one remotely disposed gaming computer in said central computer memory to enable subsequent redemption of outcome wins;

said at least one remotely disposed gaming computer including a gaming computer processor, gaming computer memory, display, player input controls and at least one program stored in said gaming computer memory that, when executed by said gaming computer processor, generates and presents on said display at least one game that yields at least one of the group consisting of said purchased outcomes and an aggregate net payoff of said purchased outcomes, and directs said at least one remotely disposed gaming computer to generate a redemption request message to be communicated to said central computer to cash-out, said at least one remotely disposed gaming computer not being in electronic communication with said central computer during game play; and a plurality of agent terminals disposed in electronic communication with said central computer, said agent terminals programmed for enabling the player to purchase outcomes from said randomized prize datastream in said central computer and for enabling the player to redeem outcome wins, where at least one of said plurality of agent terminals comprises an agent terminal read/write interface for reading data from and writing data to portable data storage media, and where said at least one remotely disposed gaming computer comprises a gaming computer read/write interface for reading data from and writing data to said portable data storage media, to communicate said outcome transfer message from said at least one of said plurality of agent terminals to said gaming computer via said portable data storage media, and to communicate said identification data and said redemption request message to said at least one of said plurality of agent terminals from said at least one remotely disposed gaming computer via said portable data storage media, wherein, said central computer includes means for processing said redemption request message to check said record in said central computer memory of said outcomes assigned to said at least one remotely disposed gaming computer in connection with said outcome purchase request to enable any payoff on said assigned outcomes to be made to the player.

2. A remote lottery system enables a player to purchase outcomes from a randomized prize datastream in a central computer and view the outcomes on at least one remotely disposed gaming computer having no on-line connection to the central computer during play, comprising:

a central computer including a processor and a central computer memory, said central computer memory operative to store a randomized prize datastream comprised of a finite series of random win/lose outcomes and identification data for said at least one remotely disposed gaming computer, said central computer further including assignment means responsive to an outcome purchase request by a player for assigning a requested number of outcomes from said randomized prize datastream to said at least one remotely disposed gaming computer, and for storing a record representative of said purchased outcomes with said identification data for said at least one remotely disposed gaming computer in said central computer memory to enable subsequent redemption of outcome wins;

said at least one remotely disposed gaming computer including a gaming computer processor, gaming computer memory, display, player input controls and at least one program stored in said gaming computer memory, that, when executed by said gaming computer processor, generates and presents on said display at least one game that yields at least one of the group consisting of said purchased outcomes and an aggregate net payoff of said purchased outcomes, and directs said at least one remotely disposed gaming computer to generate a redemption request message to be communicated to said central computer to cash-out, said at least one remotely disposed gaming computer having no on-line connection to said central computer during game play; and a plurality of agent terminals disposed in communication with said central computer, each of said agent terminals programmed for enabling the player to purchase outcomes from said randomized prize datastream in said central computer and for enabling the player to redeem outcome wins, wherein at least one of said agent terminals is adapted to physically connect said at least one remotely disposed gaming computer thereto, whereby said outcome transfer message may be communicated to said at least one remotely disposed gaming computer from said agent terminal and said identification data and said redemption request message may be communicated from said at least one remotely disposed gaming computer to said agent terminal, wherein, said central computer includes means for processing said redemption request message to check said record in said central computer memory of said outcomes assigned to said at least one remotely disposed gaming computer in connection with said outcome purchase request to enable any payoff on said assigned outcomes to be made to the player.

3. A remote lottery system which enables a player to purchase outcomes from a randomized prize datastream in a central computer and view the outcomes on a remotely disposed gaming computer with no on-line connection to the central computer during play, comprising:

a central computer including a processor and a central computer memory, said central computer memory operative to store a randomized prize datastream comprised of a finite series of random win/lose outcomes and identification data for said remotely disposed gaming computer, said central computer further including assignment means responsive to an outcome purchase request by a player for assigning a requested number of outcomes from said randomized prize datastream to said remotely disposed gaming computer, and for storing a record representative of said purchased outcomes with said identification data for said remotely disposed gaming computer in said central computer memory to enable subsequent redemption of outcome wins;

said remotely disposed gaming computer including a gaming computer processor, gaming computer memory, display, player input controls and at least one program stored in said gaming computer processor, that, when executed by said gaming computer processor, generates and presents on said display at least one game that yields at least one of the group consisting of said purchased outcomes and an aggregate net payoff of said purchased outcomes, and directs said gaming computer to generate a redemption request message to be communicated to said central computer to cash-out, said remotely disposed gaming computer having no on-line to said central computer during game play; and wherein said central computer is programmed to store at least one outcome reference string for said remotely disposed gaming computer with said identification data for said remotely disposed gaming computer in said central computer memory, said outcome reference string being comprised of a plurality of random reference outcomes, each of said reference outcomes having an address in said central computer memory, and said remotely disposed gaming computer having a corresponding outcome reference string stored in said gaming computer memory, wherein said central computer assignment means assigns outcomes from said randomized prize datastream by retrieving at least one address of a series of reference outcomes in said reference string from said central computer memory and generating said outcome transfer message which represents said at least one address to enable said remotely disposed gaming computer to reveal reference outcomes in said reference string stored in said remotely disposed gaming computer memory at said at least one address.

4. A remote lottery system which enables a player to purchase outcomes from a randomized prize datastream in a central computer and view the outcomes on remotely, comprising:

a central computer including a processor and a central computer memory, said central computer memory programmed to store a randomized prize datastream comprised of a finite series of random win/lose outcomes and identification data for said at least one gaming computer, said central computer further including assignment means responsive to an outcome purchase request by a player for assigning a requested number of outcomes from said randomized prize datastream to a device disposed remotely from said central computer, and for storing a record representative of said purchased outcomes with said identification data for said device in said central computer memory to enable subsequent redemption of outcome wins, said central computer further assigning a number of standby outcomes from said randomized prize datastream greater than said requested number of outcomes for said outcome purchase;

said remote device, said remote device comprising at least one gaming computer including a gaming computer processor, gaming computer memory, display, player input controls, and at least one program stored in said gaming computer memory, that, when executed by said gaming computer processor, generates and presents on said display at least one game that yields at least one of the group consisting of said purchased outcomes and an aggregate net payoff of said purchased outcomes, said at least one gaming computer further including means for reinvesting winnings on said requested number of outcomes to enable the purchase of said standby outcomes on said at least one gaming computer, said at least one gaming computer further including means for directing said at least one gaming computer to generate a redemption request message to be communicated to said central computer to cash-out, said at least one gaming computer not being connected to said central computer during game play, wherein, said central computer includes means for processing said redemption request message to check said record in said central computer memory of said outcomes assigned to said at least one gaming computer in connection with said outcome purchase request to enable any payoff on said assigned outcomes to be made to the player.

5. A remote lottery system which enables a player to purchase outcomes from a randomized prize datastream in a central computer and view the outcomes on at least one remotely disposed portable gaming computer which does not require an on-line connection to the central computer, comprising:

a central computer including a processor and a central computer memory, said central computer memory operative to store a randomized prize datastream comprised of a finite series of random win/lose outcomes and identification data for said at least one portable gaming computer, said central computer further including assignment means responsive to an outcome purchase request by a player for assigning a requested number of outcomes from said randomized prize datastream to said at least one portable gaming computer, and for storing a record representative of said purchased outcomes with said identification data for said at least one portable gaming computer in said central computer memory to enable subsequent redemption of outcome wins;

said at least one portable gaming computer including a gaming computer processor, gaming computer memory, display, player input controls, and at least one program stored in said gaming computer memory, that, when executed by said gaming computer processor, generates and presents on said display at least one game that yields one of the group consisting of said purchased outcomes and an aggregate net payoff of said purchased outcomes, and directs said portable gaming computer to generate a redemption request message to be communicated to said central computer to cash-out; and a plurality of agent terminals networked to said central computer, each of said agent terminals for enabling the player to purchase said requested number of outcomes from said randomized prize datastream in said central computer by entering said identification data for said at least one portable gaming computer and said outcome purchase request into said agent terminal and communicating said identification data and said outcome purchase request from said agent terminal to said central computer, and for enabling the player to redeem outcome wins by entering said identification data and said redemption request message generated by said at least one portable gaming computer into said agent terminal and communicating said identification data and said redemption request message from said agent terminal to said central computer, wherein, said central computer includes means for processing said redemption request message to check said record in said central computer memory of said outcomes assigned to said at least one gaming computer in connection with said outcome purchase request to enable any payoff on said assigned outcomes to be made to the player.

6. A lottery system, comprising:

a plurality of agent terminals disposed in electronic communication with a central computer, said agent terminals programmed for enabling a player to purchase outcomes from a randomized prize datastream from a central computer and for enabling the player to redeem outcome wins, where at least one of said plurality of agent terminals comprises an agent terminal read/write interface for reading data from and writing data to portable data storage media, and at least one gaming computer comprising a gaming computer read/write interface for reading data from and writing data to said portable data storage media, to communicate said outcome transfer message from said at least one of said plurality of agent terminals to said gaming computer via said portable data storage media, and to communicate identification data and a redemption request message to said at least one of said plurality of agent terminals from said at least one remotely disposed gaming computer via said portable data storage media to enable a payoff to be made to the player, wherein said at least one gaming computer has no on-line communication with the central computer.

* * * * *